US009930751B2

(12) United States Patent
Wendt et al.

(10) Patent No.: US 9,930,751 B2
(45) Date of Patent: Mar. 27, 2018

(54) ADJUSTABLE LIGHTING UNIT WITH CONTROLLABLE ORIENTATION AND INTENSITY OF LIGHT BEAM

(75) Inventors: Matthias Wendt, Würselen (DE); Harald Josef Günther Radermacher, Aachen (DE)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 13/388,358

(22) PCT Filed: Jul. 28, 2010

(86) PCT No.: PCT/IB2010/053428

§ 371 (c)(1),
(2), (4) Date: Feb. 1, 2012

(87) PCT Pub. No.: WO2011/015971

PCT Pub. Date: Feb. 10, 2011

(65) Prior Publication Data

US 2012/0134155 A1 May 31, 2012

(30) Foreign Application Priority Data

Aug. 5, 2009 (EP) ..... 09167235

(51) Int. Cl.

| | |
|---|---|
| ***F21S 4/00*** | (2016.01) |
| ***F21V 21/00*** | (2006.01) |
| ***H05B 37/02*** | (2006.01) |
| ***F21S 2/00*** | (2016.01) |
| ***F21V 21/15*** | (2006.01) |
| ***F21V 23/04*** | (2006.01) |

(Continued)

(52) U.S. Cl.

CPC ..... *H05B 37/02* (2013.01); *F21S 2/00* (2013.01); *F21V 21/15* (2013.01); *F21V 23/04* (2013.01); *H05B 37/029* (2013.01); *F21Y 2103/10* (2016.08); *F21Y 2115/10* (2016.08)

(58) Field of Classification Search

CPC ..... F21V 21/14–21/30; H05B 37/02
USPC ..... 362/249.01, 249.02, 249.1, 249.11, 362/249.03, 572, 804, 249.04, 249.07, 362/249.08, 249.09; 600/249

See application file for complete search history.

(56) References Cited

U.S. PATENT DOCUMENTS

| | | | | |
|---|---|---|---|---|
| 4,423,469 | A * | 12/1983 | Zerlaut et al. | 362/2 |
| 4,729,077 | A * | 3/1988 | Gordin et al. | 362/285 |
| 5,012,398 | A * | 4/1991 | Jones et al. | 362/249.07 |

(Continued)

FOREIGN PATENT DOCUMENTS

| | | | |
|---|---|---|---|
| WO | 0216824 | A1 | 2/2002 |
| WO | WO2009063411 | A1 | 5/2009 |
| WO | WO2009063411 | A2 | 5/2009 |

*Primary Examiner* — Alexander Garlen

(57) ABSTRACT

The invention provides a lighting unit (1) comprising a light source (20) and an actuator (40). The light source (20) is arranged to generate, during use, a light beam (B) whose light intensity is dependent upon an electrical power signal (I; V). The actuator (40) is arranged to orient, during use, the light beam (B) in an orientation dependent upon the electrical power signal (I; V). The orientation of the light beam has a pre-determined relationship to the light intensity of the light beam. The invention further relates to a lighting system (100) comprising at least one lighting unit, a space (1000) comprising such a lighting system, and a use of such a lighting system.

8 Claims, 10 Drawing Sheets

(51) Int. Cl.
*F21Y 103/10* (2016.01)
*F21Y 115/10* (2016.01)

(56) References Cited

U.S. PATENT DOCUMENTS

| | | | | |
|---|---|---|---|---|
| 5,093,769 | A | 3/1992 | Luntsford | |
| 5,526,245 | A | 6/1996 | Davis et al. | |
| 5,752,766 | A * | 5/1998 | Bailey et al. | 362/249.04 |
| 6,585,395 | B2 * | 7/2003 | Luk | 362/249.02 |
| 7,452,087 | B2 * | 11/2008 | Imade | 353/102 |
| 2004/0190282 | A1 * | 9/2004 | Hussaini et al. | 362/109 |
| 2007/0236810 | A1 * | 10/2007 | Masui et al. | 359/740 |
| 2008/0068838 | A1 * | 3/2008 | Galke et al. | 362/250 |
| 2008/0088241 | A1 * | 4/2008 | Chen et al. | 315/88 |
| 2008/0151052 | A1 * | 6/2008 | Erel et al. | 348/143 |
| 2009/0021184 | A1 * | 1/2009 | Shan et al. | 315/293 |

* cited by examiner

ADJUSTABLE LIGHTING UNIT WITH CONTROLLABLE ORIENTATION AND INTENSITY OF LIGHT BEAM

FIELD OF THE INVENTION

The invention relates to a lighting unit, a lighting system comprising such a lighting unit, a space with such a lighting system, and a use of such a lighting system.

BACKGROUND OF THE INVENTION

Lighting in offices is usually provided as a combination of different types of lighting systems. For example, fluorescent lighting is installed in a ceiling as general illumination of the office, desktop lamps serve for providing individual task lighting for individuals working on a desk, and halogen spots are positioned on the ceiling or on the wall for providing spot lighting for pictures hanging at the wall. In this way, light can be provided having several different illumination profiles, such as functional as well as decorative purposes, and/or as general illumination as well as individual task lighting. Most types of lighting systems are one-time installed, fixed installations, but recently also one-time installed, adjustable installations have been proposed, allowing adjusting the illumination profile. Some individual, standalone lamps may be adjustable, such as the desktop lamp.

An example of such a standalone adjustable lamp is described in US patent application US 2003/0193802 A1. This document describes a diode light source system for stage, theatre and architectural lighting including a plurality of separate flat panels for mounting a plurality of light emitting diodes emitting a plurality of diode light beams to a common focus area. A housing containing the panels has a centre base portion and a circular rim defining a housing aperture aligned with a circular rim plane having a rim plane centre arranged transverse to an axis aligned with the centre base portion. A screw arrangement positions the panels at a plurality of selected positions where each panel is oriented at a selected angle relative to the axis, and the grouped diodes emit diode light beams transverse to each separate panel.

SUMMARY OF THE INVENTION

A disadvantage of the standalone adjustable lamp described in US patent application US 2003/0193802 A1 may for instance be that adjustment of the lamp may be quite laborious and/or inconvenient, as adjusting the orientation of the panels relative to the axis requires a mechanical adjustment of the screw arrangement whereas adjusting the light intensities of the emitted diode light beams requires adjusting the electrical operating conditions, e.g. the current through the diode light sources. There may thus be a desire to provide an adjustable lamp, and more in general an adjustable lighting system, which allows easier adjusting.

A disadvantage of many of the prior art systems may for instance be that the adjusting requires a large number of parameters to be adjusted, which may not only be laborious and/or inconvenient for a user, but which may also be associated with a high degree of complexity in (electrically) connecting all components and/or with a large number of electrical connections, i.e. a complicated wiring.

There may thus be a desire to provide a flexible lighting system, which is easy to adjust by a user and/or which is easy to install and maintain, e.g. with a reduced complexity of (electrical) connections.

To achieve this, the invention provides, in a first aspect, a lighting unit comprising a light source and an actuator, wherein:

the light source is arranged to generate, during use, a light beam whose light intensity is dependent upon an electrical power signal;

the actuator is arranged to orient, during use, the light beam in an orientation in dependence upon the electrical power signal; and wherein the orientation of the light beam has a pre-determined relationship to the light intensity of the light beam.

An advantage of the lighting unit according to the invention may be that the lighting unit is easy to control, as controlling the electrical power signal results in a corresponding control of light intensity as well as orientation of the light beam. In particular, a degree of orientation—such as a degree of concentration of the light beams when a plurality of light beams is provided by the lighting unit—may correspond to a light intensity of the light beam(s), such that e.g. an increase of the light intensity to illuminate a workplace may be directly coupled to directing the light beam to the workplace.

Another advantage of a pre-determined relationship between the orientation and the light intensity of the light beam may be that a user does not need to contemplate or experimentally determine which orientation matches a certain light intensity, as the lighting unit provides a suitable orientation corresponding to the light intensity.

The term "electrical power signal" may relate to an electrical power signal usable for operating the light source to generate a light beam with a light intensity, e.g. a (DC or pulsed) current, a (DC or pulsed) voltage. The electrical power signal may be externally provided to the lighting unit, or alternatively be internally created in the lighting unit, e.g. from transforming an externally supplied supply power signal, or from an internal power source.

The term "actuator" may relate to a device capable of acting upon the light source to orient the light beam, either by directly connecting to the light source (e.g. with the light source mounted directly on the actuator) or indirectly via a mechanical connection.

The term "orientation" may relate to an orientation relative to a reference direction, such as an angle relative to a normal to a reference plane, or may e.g. refer to directing the light beam towards a target, e.g. towards a workplace. In particular, when a plurality of light beams are provided by one or more lighting units, orienting the light beams may correspond to providing a concentration of light at a target by directing all, or a subset of, the light beams to the—common—target. This may further be referred to as focussing the beams.

The term "pre-determined relationship" may relate to the orientation of the light beam and the light intensity of the light beam being functionally related to each other, in particular in a one-to-one relationship. Each setting of light intensity, defined by the electrical power signal, thus relates to a specific orientation. A change of light intensity, by changing the electrical power signal, thus results in a corresponding change in orientation, effected by the—same—electrical power signal. The pre-determined relationship may be a one-time determined relationship that cannot be changed. The pre-determined relationship may correspond to a user-selected pre-determined relationship, which is selected by a user, e.g. using a remote control or another type of suitable user interface, from a plurality of pre-determined relationships (which may also be referred to as presets).

As will be clear to the person skilled in the art, embodiments may be combined.

In an embodiment, the lighting unit may further comprise a power terminal, being electrically connectable to an electrical power supply, and being arranged to provide, during use, the electrical power signal.

The term "power terminal" may relate to one or more electrical connections arranged to connect to an external power supply and to supply the electrical power signal to the light source and the actuator. Thus, the lighting unit itself does not need to include a power supply, thereby reducing e.g. the cost of the lighting unit and/or the total lighting installation when a plurality of such lighting units connected to a single power supply are used. The power terminal may directly receive the electrical power signal from the external power supply. Alternatively, the power terminal may be electrically connected to the external power supply via a transformer, wherein the transformer receives a supply power from the external power supply and transforms it into the electrical power signal and provides the electrical power signal to the power terminal. For example, the supply power may be a standard AC mains power signal which is dimmed into e.g. a phase-cut power signal using a standard dimmer, such as a TRIAC-dimmer; the transformer may transform the phase-cut power signal to the electrical power signal which is received by the power terminal. In an embodiment, the power terminal is a connector, such as an electrical plug, for a power supply, such as a socket.

In an embodiment, the electrical power signal is a current. The light source and the actuator are thus operated in dependence on the current. The current may e.g. be a DC current, the current level defining the light intensity of the light beam generated by the light source and the orientation of the light beam as provided by the actuator. The current may e.g. be a pulse-width modulated current with a fixed current level, the pulse width defining the light intensity of the light beam generated by the light source and the orientation of the light beam as provided by the actuator. The current may alternatively be a pulse-width modulated current, the current level of which is also controllable, thereby defining light intensity and orientation from the pulse width and the current level.

According to a further embodiment, the light source and the actuator are electrically connected in series as a series arrangement, wherein the series arrangement is arranged to receive, during use, the current (I). The series arrangement may be electrically connected to the power terminal for connecting to the electrical power supply for receiving the current during use. The light source and the actuator are thus connected to receive the same current.

In an embodiment, the electrical power signal is a voltage. The light source and the actuator are thus operated in dependence on the voltage.

According to a further embodiment, the light source and the actuator are electrically connected in parallel as a parallel arrangement, wherein the parallel arrangement is arranged to receive, during use, the voltage (V). The parallel arrangement may be electrically connected to the power terminal for connecting to the electrical power supply for receiving the voltage during use. The light source and the actuator are thus connected to receive the same voltage.

In an embodiment, the light intensity is dependent on an average level of the electrical power signal. The electrical power signal thus defines the light intensity from its average signal level, which may e.g. be substantially proportional to the average signal level.

In an embodiment, the orientation is dependent on the average power of the electrical power signal. The electrical power signal thus defines the orientation from its average power, which may e.g. be proportional to a time-averaged square of the current. The average power may e.g. relate to a power dissipation in the actuator, wherein the power dissipation defines how the actuator acts on the orientation of the light beam.

In an embodiment, the light intensity is dependent on the average level of the electrical power signal and the orientation is dependent on the average level of the electrical power signal. The electrical power signal thus defines the light intensity as well as the orientation of the light beam from its average signal level. The pre-determined relationship may thus e.g. correspond to a linear relationship between the light intensity and the orientation.

In yet another embodiment, the light intensity is dependent on the average level of the electrical power signal and the orientation is dependent on the average power of the electrical power signal. The electrical power signal thus defines the light intensity from its average signal level and the orientation from its average power. For example, when the electrical power signal is a current, the pre-determined relationship may thus e.g. correspond to a quadratic relationship between the light intensity and the orientation.

In an embodiment, the light source comprises at least one light-emitting diode (LED). Solid state LEDs as light source(s) are especially desired because of their small dimensions, low weight and narrow beams.

In an embodiment, the light source is provided on a carrier, and the actuator is arranged to mechanically act upon the carrier for orienting the light beam. The term "carrier" may relate e.g. to a printed circuit board provided with electrical signal lines for providing the electrical power signal to the light source, which mechanically interacts with the actuator when the actuator is driven from the electrical power signal. The carrier may be mechanically robust and rigid. This may have an advantage in that the actuator acts on a robust mechanical carrier, and not directly on a relatively delicate light source. The carrier may carry a plurality of light sources. The carrier may also be a cable, a tube, a bar, a panel, etc. The term "carrier" may relate to a pliable surface capable of being provided with different shapes and with electrical signal lines for providing the electrical power signal to the light source, wherein the pliable surface is shaped from a mechanical interaction with the actuator when the actuator is driven from the electrical power signal.

In an embodiment, the lighting unit comprises a plurality of light sources provided on a plurality of carriers, wherein the actuator is arranged to mechanically act upon the plurality of carriers for orienting the respective light beam(s). A single actuator may thus advantageously act upon a plurality of carriers for simultaneously orienting the respective light beams, e.g. to concentrate the respective light beams to a common point. A single actuator may e.g. be provided with a plurality of carriers arranged in for instance a hexagon-shape, and arranged to act upon the central point of the plurality of carriers, such as the hexagon, for changing the degree of focussing of the respective light beams. This may advantageously reduce the complexity and/or cost of the lighting unit. In an embodiment, the lighting unit comprises a plurality of carriers, at least some of the plurality of carriers comprising a plurality of LEDs.

In an embodiment, the actuator comprises a bimetal actuator element arranged to orient, during use, the light beam in dependence on the electrical power signal. The bimetal actuator element may be mechanically connected to the carrier and thus act upon the carrier for orientating the carrier and thus the light beam. The bimetal actuator element may provide a convenient and/or simple actuator, that is directly driven from the electrical power signal. The bimetal actuator element may particularly be arranged to be heated by the electrical power signal to a temperature, and to orient the light beam in dependence on the temperature of the bimetal actuator element.

In a further embodiment, the light source is provided on the bimetal actuator element of the actuator. The bimetal actuator element thus carries the light source, wherein the bimetal actuator element may be advantageously arranged to directly orient the light beam generated by the light source. In particular, the bimetal actuator element may be arranged in thermal communication with the light source. The light intensity of the light beam may then be directly defined from the electrical power signal supplied to the light source, whereas the orientation of the light beam is defined from the electrical power signal supplied to the light source via the heating up of the light source generating the light beam, and the resulting change of shape of the bimetal actuator element. This heating is typically proportional to the average power of the electrical power signal. The further embodiment may thus advantageously provide a relatively simple and/or robust lighting unit, wherein light intensity and orientation of the light beam are both defined from the electrical power signal according to a pre-determined relationship.

In another embodiment, the actuator comprises an electromechanical solenoid arranged to orient, during use, the light beam in an orientation in dependence upon the electrical power signal. The electromechanical solenoid may be mechanically connected to the carrier for orienting the carrier and thus the light beam. The electromechanical solenoid may thus provide an alternative convenient and/or simple actuator, that is directly driven from the electrical power signal. The electrical power signal may in particular generate a mechanical force in the electromechanical solenoid, which mechanical force may be approximately proportional to the current level when the electrical power signal is a current, and this mechanical force may act on the carrier to orient the carrier and thus orient the light beam. The electromechanical solenoid may in particular comprise a core in electromagnetic communication with an electromagnetically inductive coil, wherein the electromechanical solenoid is arranged to position the core relative to the electromagnetically inductive coil in dependence on the electrical power signal for orienting the light beam.

In another embodiment, the actuator comprises a piezo element, arranged to orient, during use, the light beam in an orientation in dependence upon the electrical power signal. The piezo element may thus provide an alternative convenient and/or simple actuator, that is directly driven from the electrical power signal. The electrical power signal may in particular generate a strain in the piezo element, which strain may be approximately proportional to the voltage level when the electrical power signal is a voltage, and this strain may act on the carrier to orient the carrier and thus orient the light beam.

In an embodiment, the lighting unit further comprises an electrical power supply arranged to provide the electrical power signal. The lighting unit may thus be operated independently of an external supply signal, and/or the electrical power supply may be arranged to establish the electrical power signal from an externally supplied external supply signal, e.g. by transforming the externally supplied external supply signal to the electrical power signal. The electrical power signal may thus e.g. be scaled according to the characteristics of the lighting unit, while an external supply signal is used that may be provided with standard means, such as an AC mains signal that is dimmed using a standard, e.g. TRIAC-based, dimmer.

A second aspect of the invention provides a lighting system comprising at least one lighting unit according to the invention, in particular a plurality of lighting units according to the invention. The plurality of lighting units may be commonly operated from a single electrical power signal, or alternatively e.g. be provided with respective individual electrical power signals. An advantage of the lighting system according to the invention may be that the lighting system may be easy to control, as controlling the electrical power signal(s) results in a corresponding control of light intensities as well as orientations of the light beam(s). In particular, the degree of concentration of several light beams of the plurality of light beams may be provided by the lighting system, in correspondence with the light intensities of the light beam(s), such that e.g. an increase of the light intensity to illuminate a workplace may be directly coupled to directing the light beam to the workplace using a subset of the plurality of lighting units, whereas the other lighting units may have light beams with a moderate light intensity at a substantially diffuse illumination for illuminating the area around the workplace.

In an embodiment, the lighting system further comprises an electrical power supply in electrical communication with the plurality of lighting units and arranged to provide the plurality of lighting units with the electrical power signal. The electrical power supply may be arranged to provide a single electrical power signal, thereby defining a common light intensity and a common orientation of all light beams generated by the lighting units. The electrical power supply may be arranged to provide a plurality of electrical power signals to the plurality of lighting units, thereby defining individual light intensities and corresponding orientations of the light beams generated by each of the lighting units. The lighting units may be arranged in groups, each group receiving an electrical power signal defining the light intensities and corresponding orientation of the light beams generated by the lighting units per group.

In the description above, the term "plurality of light sources", such as a "plurality of LEDs" may refer to 2 or more light sources, especially 2-100,000 light sources, for instance 2-10,000, like 4-300, such as 16-256. Hence, the carrier, the lighting unit or the lighting system may comprise a plurality of light sources, such as LEDs. In general, the carrier, or more particularly, the lighting unit or the lighting system, may comprise light sources such as LEDs at a density of 2-10,000 light sources/$m^2$, particularly 25-2,500 light sources/$m^2$, wherein the density is measured relative to a total area covered by the lighting unit or the lighting system. Note that the plurality of light sources, such as a plurality of LEDs, may be distributed over a plurality of carriers. The term "lighting system" may also refer to a plurality of lighting systems.

The light source may comprise any light source, such as a small incandescent lamp or a fiber tip or fiber irregularity (arranged to let light escape from the fiber; this embodiment has the advantage that it is relatively cheap), but may particularly comprise a LED (light emitting diode) (as light source). A specific advantage of using LEDs is that they are relatively small and may therefore be arranged in a large number. Another specific advantage of using LEDs is that they may provide relatively narrow beams, allowing an accurate definition of the illumination profile generated by the lighting system. The term LED may refer to OLEDs, but especially refers to solid state lighting. Unless indicated otherwise, the term LED herein further refers to solid state LEDs.

In an embodiment, the LEDs are provided at a density of at least 1 LED per 100 $cm^2$. In a further embodiment, the LEDs are provided at a density of at least 1 LED per 10 $cm^2$. In an embodiment, the plurality of elements is at least 20. In an embodiment, the plurality of elements comprise in total at least 100 light sources. At such a relatively large density, such a number of elements and/or such a number of light sources, a large degree of flexibility is obtained. Moreover, a large number of LEDs allow the use of LEDs with a relatively low power dissipation, which may be advantageous from a thermal point of view. It will be appreciated that the number of LEDs used in the lighting system may be determined in dependence on e.g. light level(s) required, type and characteristics (such as light output level, colour of light, thermal characteristics and/or electrical operating parameters) of the LEDs and required degree of flexibility in the illumination profile generated from the lighting system.

A third aspect of the invention provides a space comprising a lighting system according to any one embodiment of the second aspect of the invention. The space may e.g. be a room, an office, a hallway, a corridor, a factory floor, a hospitality area, or any other space in which an adjustment of lighting conditions without the need to re-install the lighting system in whole or in part may be expected. The space may in particular be a space with a plurality of working areas with individual lighting requirements. When such a space comprises a lighting system according to the invention, all working areas can be optimally illuminated without any re-installation and without the need for additional lights, such as e.g. a desktop lamp. In further embodiments, the lighting system is arranged to illuminate a part of a wall of the space. This omits the need for additional lighting units for perimeter wall lighting and may allow for a consistent illumination profile in the whole space. In an embodiment, the lighting system provides an illumination profile changing over a pre-determined time period from a first illumination profile to a second illumination profile. The changing may be repeated, providing a gradual cycling between two or more illumination profiles.

In an embodiment, the lighting system is attached to a ceiling of the space. The lighting system may be directly attached to the ceiling or, alternatively, suspended from the ceiling.

In a further embodiment, the lighting system further comprises a controller, which may be arranged external to the ceiling but which may also be integrated in the ceiling, and which is arranged to control the lighting system, and particularly the individual light units of the lighting system. In this way, an illumination profile may be provided that is e.g. different at different times of the day, depending on the number of office workers and their positions and/or depending on the activities in the room (e.g. different for meetings and standalone working). For example, intensity and illumination profile of the light generated by the lighting system may be variable and may be controlled by the controller. Further, intensity and illumination profile may be dependent on a sensor signal of a sensor (such as a touch, (day)light or approach sensor), wherein the sensor is arranged to sense an object on or in the room, and wherein the controller is arranged to control the intensity and illumination profile in dependence on the sensor signal. For example, the controller may provide task lighting to a workspace in a room, said lighting having a relatively high intensity and an illumination profile corresponding to a concentrated profile of the workspace when the presence of a person is detected at the workspace by the sensor, whereas it provides general lighting with a relatively moderate intensity and an illumination profile corresponding to a diffuse and/or uniform profile otherwise. The controller may also be a remote controller.

In yet a further embodiment, the invention provides the lighting system in combination with a sensor and the controller, wherein the sensor is arranged to provide a sensor signal when the sensor is approached or touched, and wherein the controller is arranged to control the lighting system.

The term "controller" may also relate to a plurality of controllers. Particularly for larger units or systems, a plurality of controllers may be applied. In an embodiment, the plurality of controllers are arranged to control a subset of a plurality of light beams.

A fourth aspect of the invention provides a use of a lighting unit according to the invention, wherein the use comprises establishing and conditioning the electrical power signal of the lighting unit to generate the light beam with the pre-determined light intensity and the pre-determined orientation. The use provides a convenient manner of setting, changing or defining an illumination profile with a light intensity and an orientation in a coupled manner.

A fifth aspect of the invention provides a use of a lighting system according to the invention, the use comprising generating a plurality of light beams comprising one or more first light beams and one or more second light beams, wherein the one or more first light beams have a first pre-determined light intensity and a first pre-determined orientation associated with providing general lighting at a general light level, and an orientation corresponding to diffuse illumination, generated in dependence on a first electrical power signal; and the one or more second light beams have a second pre-determined light intensity and a second pre-determined orientation associated with providing directional lighting at a directional light level, preferably larger than the general light level, generated in dependence on a second electrical power signal.

The use of the lighting system may thus provide e.g. an illumination profile that is associated with concentrating light generated by the light sources on part of the plurality of lighting units of the lighting system to a plurality of working areas. The working areas may e.g. correspond to office desks in an office, workbenches in a workshop, or individual working areas on a factory floor. Defining the illumination profile may be further associated with providing general illumination light. Providing the illumination profile may be associated with de-concentrating light generated by the light sources on part of the plurality of lighting units. This allows providing diffusely illuminated areas, e.g. corresponding to a corridor or an open area in e.g. an office, workshop or factory floor. Providing the illumination profile may be associated with slowly changing the illumination profile over a pre-determined time period from a first illumination profile to a second illumination profile.

The lighting system may thus be used for defining an illumination profile in a space. For example, one or more parts of the space may thus be provided with concentrated light generated by the light sources on part of the plurality of lighting units; preferably a plurality of parts is provided with concentrated light. The one or more parts of the space with concentrated light may thus be provided e.g. at different positions and different moments of use of the lighting system. The space may thus be provided with, e.g., one or more areas in the space where light generated by the light sources on part of the plurality of lighting units is deconcentrated, thus providing diffusely illuminated areas in the space. The one or more parts of the space with concentrated light may be associated with e.g. working areas in the space.

In a further embodiment, the use of the lighting system alternatively or additionally provides light directed to a wall of the space, for generating perimeter lighting without the need for installing additional light sources for illuminating the wall. Illuminating the wall with the same lighting system as that used for general lighting and task lighting may be advantageous for defining a consistent illumination profile across the whole space.

Throughout this document, the terms "blue light" or "blue emission" especially relate to light having a wavelength in the range of about 410-490 nm. The term "green light" especially relates to light having a wavelength in the range of about 500-570 nm. The term "red light" especially relates to light having a wavelength in the range of about 590-650 nm. The term "yellow light" especially relates to light having a wavelength in the range of about 560-590 nm. The term "light" herein especially relates to visible light, i.e. light having a wavelength selected from the range of about 380-780 nm. Light emanating from the ceiling into a space under the ceiling may herein also be indicated as "ceiling light". Light emanating from the ceiling onto a wall under the ceiling may herein be indicated as "ceiling light" or as a "wall illumination light".

Unless indicated otherwise, and where applicable and technically feasible, the phrase "selected from the group consisting" of a number of elements may also refer to a combination of two or more of the enumerated elements. Terms like "below", "above", "top", and "bottom" relate to positions or arrangements of items which would be obtained if the lighting system were arranged substantially flat to, particularly below, a substantially horizontal surface, with the lighting system bottom face substantially parallel to the substantially horizontal surface and facing away from the ceiling into the room. However, this does not exclude the use of the lighting system in other arrangements, such as against a wall, or in yet other (e.g. vertical) arrangements.

BRIEF DESCRIPTION OF THE DRAWINGS

Embodiments of the invention will now be described, by way of example only, with reference to the accompanying schematic drawings in which corresponding reference symbols indicate corresponding parts, and in which.

DETAILED DESCRIPTION

Figure 1A:
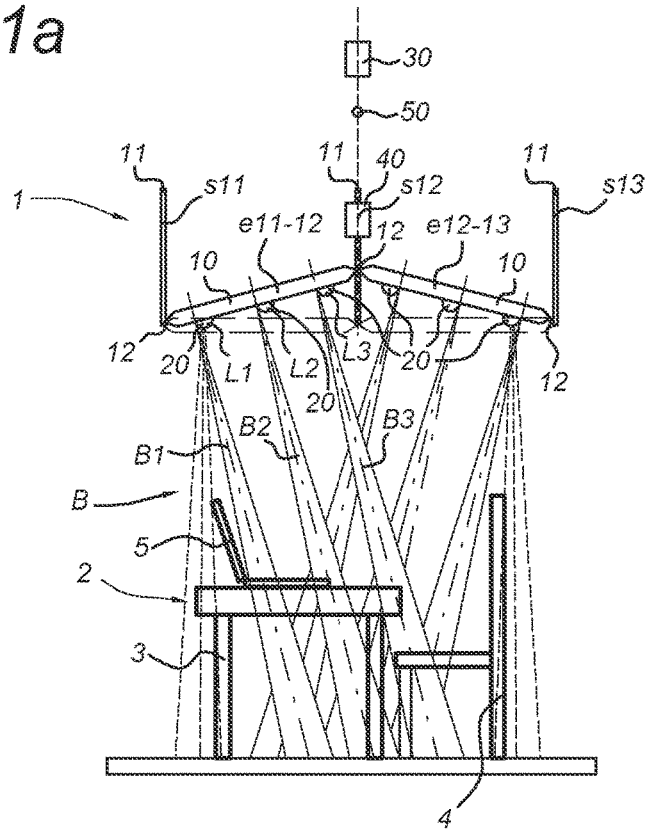
FIG. 1*a* schematically depicts an embodiment of a lighting unit according to the invention.

FIG. 1*a* schematically depicts an exemplary embodiment of a lighting unit 1 according to the invention. The lighting unit 1 is attached to a ceiling (not shown) of an office space (not shown). The lighting unit 1 may alternatively be provided as a standalone lighting unit, e.g. as a desk lamp, or a wall-mountable lamp. FIG. 1 shows a workspace 2 in the office space. The workspace has, by way of example, a desk 3 with a chair 4, and a computer display 5 on the desk.

The lighting unit 1 has a plurality of supports 11, indicated by means of individual numbers s11, s12, s13. The supports 11 are drawn so as to extend down from the ceiling, and may also be referred to as suspensions 11, but may be directly attached to or integrated in the ceiling.

Two elements 10, individually referenced e11-12 and e12-13, are adjustably connected to the supports s11, s12, s13, with adjustable connections 12: element s11-12 connects to the two supports s11 and s12 and element e12-13 connects to the two supports s12 and s13. The term "adjustable connection" is used to indicate a connection between the element and the support that is adjustable; in particular, the element may be hinged to or pivotally connected to the support. Each of the two elements 10 comprises a light source 20 for providing a light beam B whose light intensity is dependent on an electrical power signal (not drawn). The electrical power signal may be externally provided to the lighting unit 1, or alternatively it may be provided from an electrical power supply incorporated in the lighting unit 1, or alternatively it may be provided from an electrical power transformation in the lighting unit 1 of a power supply signal provided from an external supply 30 via a power terminal 50, as indicated with the dashed line. The elements 10 may also be referred to as carriers 10, wherein the word "carrier" emphasizes that the light source(s) 20 is (are) carried by the carrier(s) 10. In this example, the light source 20 comprises a plurality of individual light sources L1, L2 and L3, for providing light beams B1, B2 and B3, which may together compose light beam B. The light sources L1, L2, L3 may e.g. be LEDs.

Support s12 is provided with an actuator 40, which is arranged to adjust the orientation of the elements e11-12 and e12-13 in dependence on the electrical power signal (not drawn): a first orientation is schematically shown in dashed lines, corresponding to the elements 10 being oriented in one plane and the corresponding light beams, shown in dashed lines, being emitted substantially at right angles to the ceiling towards the floor 6; a second orientation is schematically shown in full lines, corresponding to the elements 10 being oriented at an angle and the corresponding light beams, shown in full lines, being oriented towards the work space 2, where the light beams provide concentrated light for task lighting.

The lighting unit can thus provide task lighting to workspace 2, by orienting elements e11-e12 and e12-13 at angles relative to the respective supports s11, s12 and s13, thus directing the beams generated by the light sources on the elements to the workspace 2, i.e. by orienting the light beams from elements e11-e12 and e12-13 towards the work space 2, as shown in full lines. Light originating from elements e11-e12 and e12-13 is thus concentrated at work space 2. The light beams B provided by the light sources 20 on elements e11-e12 and e12-13 have a relatively high light intensity (which may also be referred to as brightness). The light intensity of the light beams B has a pre-determined relationship with the orientation of the light beam: when the orientation corresponds to a high degree of concentration, the light beams have a large light intensity, thus providing suitable lighting conditions for task lighting; whereas the light intensity is moderate when the orientation corresponds to a low degree of concentration, i.e. a flat illumination profile, thus providing suitable lighting conditions for general lighting, typically associated with diffuse lighting. The light intensity may e.g. be substantially proportional to the degree of concentration, which may e.g. be parameterized by the angle between the carrier 10 and a plane parallel to the ceiling. The lighting unit could alternatively be controlled to provide general illumination to the work space 2, by orienting elements e11-e12 and e11-12 substantially perpendicularly to the respective supports s11, s12 and s13, i.e. substantially parallel to the office floor, as shown in dashed lines. The light intensity of the corresponding light beams is moderate, with the orientation corresponding to a low degree of concentration for providing suitable lighting conditions for general lighting, in particular substantially diffuse lighting. An illumination profile may thus be defined and/or adjusted using the lighting unit 1, by at least adjustably orienting the two elements e11-12 and e12-13 relative to the respective supports s11, s12, s13, thus orienting the corresponding light beams, and adjusting the light intensity of the corresponding light beams according to a pre-determined relationship with their respective orientations. Defining the illumination profile may be associated with concentrating light beams generated by the light sources L1, L2, L3, . . . on the two elements e11-12 and e12-13, to e.g. the working area 5. As will be clear to the person skilled in the art, the invention is not limited to the elements 10 and/or supports 11 and/or light sources 10 in the form of a plurality of light sources L1-L3, etc., shown in the schematic drawings.

Figure 1B:
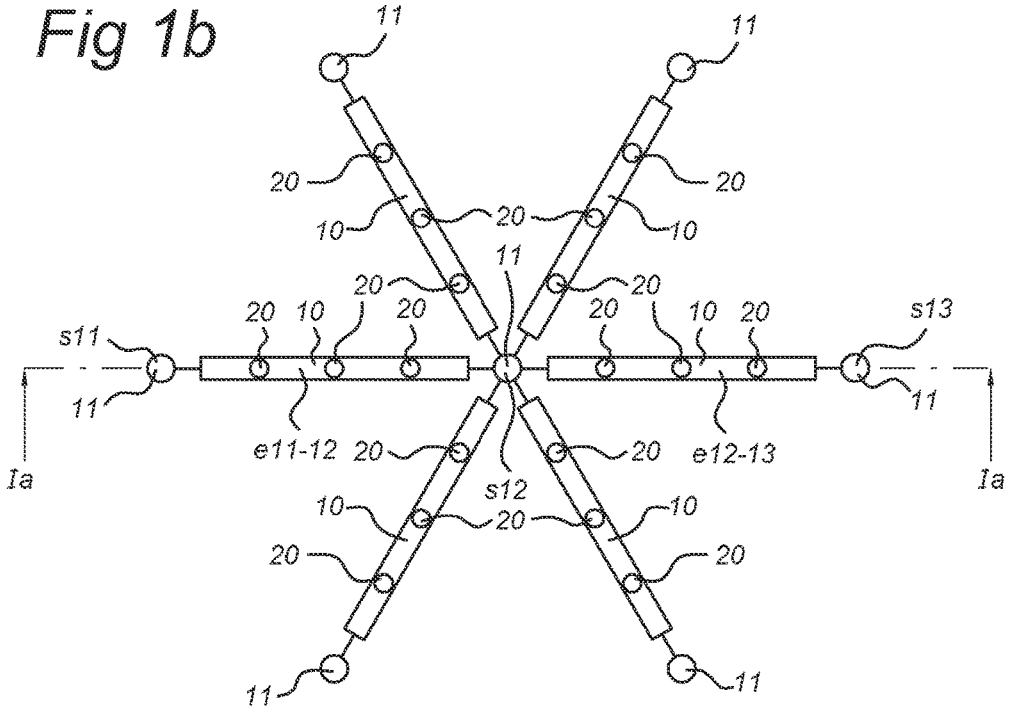
FIG. 1*b*-FIG. 1*d* schematically depict a plurality of examples of the embodiment shown in FIG. 1*a;*

FIG. 1*b* shows a bottom view of an exemplary lighting unit 1. The lighting unit 1 is a hexagon-shaped unit having a star-wise arrangement of a plurality of elements or carriers 10, each carrying a plurality of light sources 20, and being adjustably connected to supports 11. The carriers 10 may be bar-shaped as shown. As shown, the leftmost support 11 may correspond e.g. to support s11 of FIG. 1*a*, the middle support 11 may correspond to support s12 of FIG. 1*a*, the rightmost support 11 may correspond e.g. to support s13 of FIG. 1*a*, and the respective two elements 10 may correspond to elements e11-12 and e12-13 of FIG. 1*a*. Line Ia-Ia is drawn to indicate a cross-section though FIG. 1*b*, corresponding to the plane of the drawing of FIG. 1*a*. In this example, each carrier 10 carries three light sources in the form of e.g. three white-light LEDs, and the lighting unit 1 has six carriers 10.

It will be appreciated that other pluralities of carriers 10 are also possible within one lighting unit, e.g. two, three, four, or an even larger plurality. It will be appreciated that other pluralities of light sources 20 per carrier 10 may also be possible, depending on e.g. the type of light source, the dimensions of the carriers 10 and the intended use of the light source (e.g. defining the distance between the lighting unit 1 and the work space 2, which may be referred to as mounting height or ceiling height).

All carriers 10 are connected by means of an adjustable connection at the outer end (relative to the star-wise arrangement) of the carriers to fixed supports 11 and with their other ends to an actuator 40 provided at the support 11 at the center of the star-wise arrangement. Thus, in this schematically depicted embodiment all carriers 10 are jointly actuated by the actuator 40 for jointly changing the orientation of the generated light beams, in particular for changing the degree of concentration of the generated light beams. In particular, when the light beams have a high intensity, the light beams from all six elements 10 are oriented to provide a highly concentrated illumination profile, e.g. a high-brightness, substantially focussed illumination spot at a workplace. When the light beams have a moderate intensity, the light beams from all six elements are emitted substantially parallel to each other, thus providing relatively diffuse illumination suitable for, e.g., general lighting.

Figure 1C:
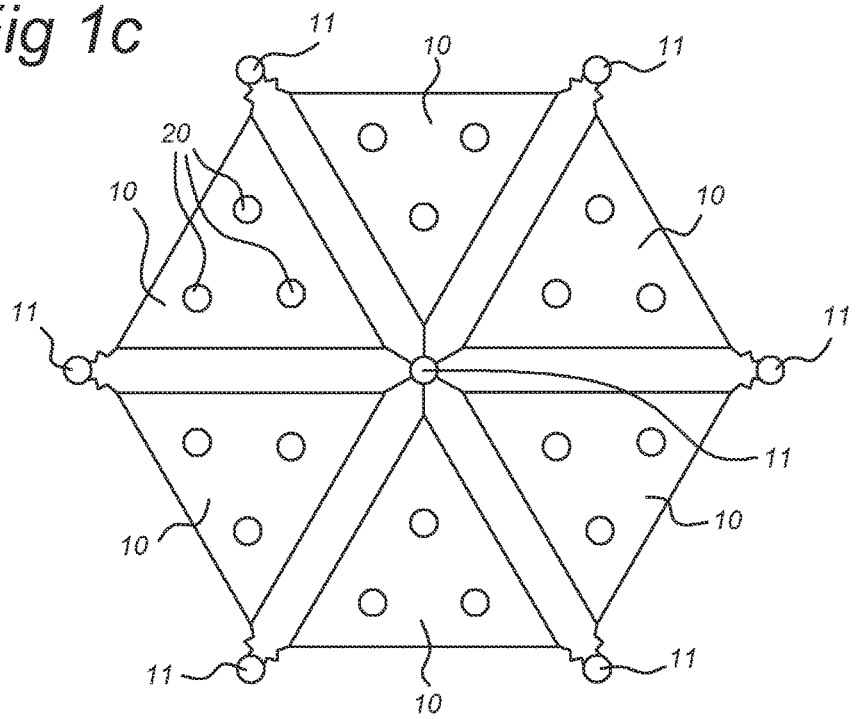

FIG. 1*c* shows a bottom view of an alternative exemplary lighting unit 1. The lighting unit 1 is a hexagon-shaped unit having a star-wise arrangement of a plurality of elements or carriers 10, each carrying a plurality of light sources 20, and being adjustably connected to supports 11. The embodiment differs from the embodiment shown in FIG. 1*b* in that the carriers 10 are substantially triangular-shaped and are connected with two adjustable connections at two corresponding edges of the triangle at the outer ends of the hexagon-shaped lighting unit 1, however, like the embodiment of FIG. 1*b*, the carriers are jointly connected with their other ends to an actuator 40 provided at the support 11 at the center of the star-wise arrangement. The arrangement of FIG. 1*b* may allow a larger number of light sources 20 per carrier 10 than the arrangement of FIG. 1*a*, and/or a more even distribution of light sources 20 over the area covered by the lighting unit 1.

Figure 1D:
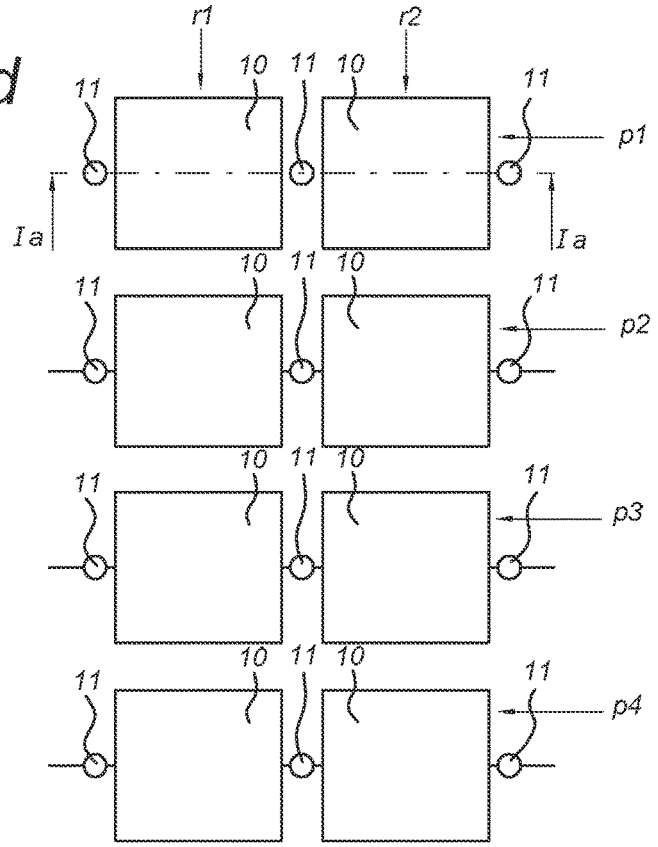

FIG. 1*d* shows a bottom view of another alternative exemplary lighting unit 1. The lighting unit 1 is a rectangular-shaped unit and has a double row-wise arrangement of a plurality of elements or carriers 10, each carrying a plurality of light sources 20. The double row-wise arrangement comprises pairs p1, p2, p3, p4 of elements 10, adjustably connected to supports 11. The left carriers of each pair are aligned in a first row r1, the right carriers of each pair are aligned in a second row r2. The embodiment differs from the embodiment shown in FIG. 1*c* in that the shape of the lighting unit 1 is rectangular, and in that the carriers 10 are substantially rectangular and are connected with adjustable connections at the outer edge of the rectangular-shaped lighting unit 1, and they are jointly connected at their inner, adjacent edges to an actuator 40 provided at the support 11 at the center line of the double row-wise arrangement. The arrangement of FIG. 1*d* is arranged to provide uniform lighting with a moderate light intensity by orienting all carriers 10 in a plane, whereas a line-shaped concentration of high-intensity light beams may be provided by orienting the two rows r1 and r2 at an angle with respect to each other, as is shown in FIG. 1*a*, which corresponds to the cross-section along line Ia-Ia.

Figure 2:
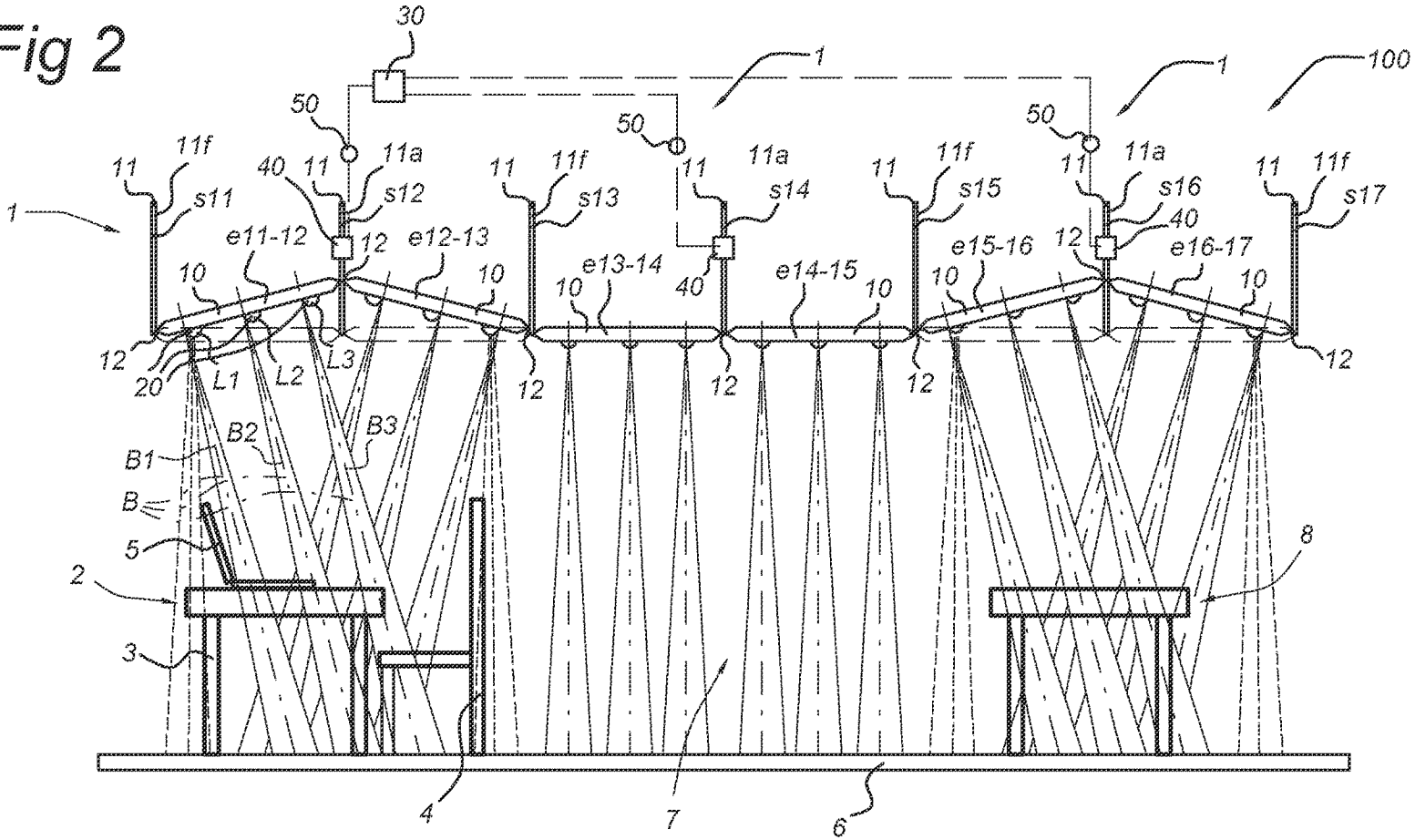
FIG. 2 schematically depicts an alternative embodiment of a lighting system according to the invention.

FIG. 2 schematically depicts an alternative exemplary embodiment of a lighting system 100 according to the invention, attached to a ceiling (not shown) of an office space (not shown), and comprising a plurality of lighting units 1. FIG. 2 shows two workspaces 2, 8 at different positions on the office floor 6 in the office space, separated by a corridor 7. Each workspace has, by way of example, e.g. a desk 3 with a chair 4, and a computer display 5 on the desk.

The lighting system 100 may include a plurality of supports 11, individually numbered as s11, s12, s13, s14, s15, s16, s17. The supports 11 may be arranged on a grid (not shown) and extend down from the ceiling, or may be directly attached to or integrated in the ceiling. It will be understood that the grid may extend in two dimensions along the ceiling. The grid may e.g. correspond to a triangular or hexagonal lattice.

Elements 10, individually referenced e11-12, e12-13, e13-14, e14-15, e15-16, e16-17, are adjustably connected to the supports s11, s12, s13, s14, s15, s16, s17 with adjustable connections 12: element s11-12 connects to the two supports s11 and s12, element e12-13 connects to the two supports s12 and s13, etc. Each of the elements 10 comprises a light source 20 for providing a light beam B with a light intensity in dependence on a respective electrical power signal (not drawn). The electrical power signals may be externally provided (e.g. from an external power supply 30) to the lighting units 1 via power terminals 50, or may alternatively be provided from one or more electrical power supplies 30 incorporated in the lighting unit 1, or may alternatively be provided from one or more electrical power transformations in the lighting unit 1 of a power supply signal provided from an external supply 30 via power terminals 50, as indicated with dashed lines. Again, the elements 10 may also be referred to as carriers 10, wherein the word "carrier" emphasizes that the light sources 20 are carried by the carriers 10. In this example, the light source 20 comprises a plurality of individual light sources L1, L2 and L3, for providing light beams B1, B2 and B3, which together compose light beam B. The light sources L1, L2, L3 may e.g. be LEDs. In the example shown, supports s12, s14 and s16 are provided with respective actuators 40, which are arranged to adjust the orientation of, respectively, the elements e11-12 and e12-13, the elements e13-14 and e14-15 and the elements e15-16 and e16-17.

The lighting system 100 may be provided as a plurality of lighting units 1: a first lighting unit comprising elements e11-e12 and e12-13 and their corresponding—common—actuator 40 operated from a first electrical power signal, a second lighting unit comprising elements e13-e14 and e14-15 and their corresponding—common—actuator 40 operated from a second electrical power signal, and a third lighting unit comprising elements e15-e16 and e16-17 and their corresponding—common—actuator 40 operated from a third electrical power signal. The lighting system 100 may alternatively be provided as a single lighting unit, comprising all elements e11-12, e12-13, e13-14, e14-15, e15-16 and e16-17, operated from three electrical power signals to the three respective actuators connecting to elements e11-e12 and e12-13, elements e13-e14 and e14-15, and elements e15-e16 and e16-17, respectively.

The lighting system 100 may provide task lighting to workspace 2, by orienting elements e11-e12 and e12-13 at angles relative to the respective supports s11, s12 and s13, thus directing the beams generated by the light sources on the elements to the workspace 2, i.e. by orienting the light beams from elements e11-e12 and e12-13 towards the workspace 2. Light originating from elements e11-e12 and e12-13 is thus concentrated at workspace 2. The light beams B provided by the light sources 20 on elements e11-e12 and e12-13 have a relatively high light intensity (which may also be referred to as brightness). The light intensity of the light beams B may have a pre-determined relationship with the orientation of the light beam: when the orientation corresponds to a high degree of concentration, the light beams have a high light intensity, thus providing suitable lighting conditions for, e.g., task lighting; whereas the light intensity is moderate when the orientation corresponds to a low degree of concentration, i.e. a flat illumination profile, thus providing suitable lighting conditions for general lighting, typically associated with diffuse lighting. The light intensity may e.g. be substantially proportional to the degree of concentration, which may e.g. be parameterized by the angle between the carrier 10 and a plane parallel to the ceiling. Likewise, the lighting system provides task lighting to work space 5, by positioning elements e15-e16 and e16-17 at angles relative to the respective supports s15, s16 and s17, thus directing the beams generated by the light sources on the elements to the workspace 5, i.e. by orienting the light beams from elements e15-e16 and e16-17 towards workspace 5. The lighting system further provides general illumination over a part of the office space, in the example of FIG. 2 the corridor 7, by orienting elements e13-e14 and e14-15 substantially perpendicularly to the respective supports s13, s14 and s15, i.e. substantially parallel to the office floor. The light intensity of the corresponding light beams is moderate, with the orientation corresponding to a low degree of concentration for providing suitable lighting conditions for general lighting, in particular substantially diffuse lighting. An illumination profile may thus be defined and/or adjusted using the lighting system 100, by at least adjustably orienting at least two of the plurality of elements e11-12, e12-13, e13-14, e14-15, e15-16, e16-17 relative to the respective supports s11, s12, s13, s14, s15, s16, s17, thus orienting the corresponding light beams, and adjusting the light intensity of the corresponding light beams according to a pre-determined relationship with their respective orientations. Defining the illumination profile may be associated with concentrating light generated by the light sources L1, L2, L3, . . . on the plurality of elements e11-12, e12-13, e13-14, e14-15, e15-16, e16-17 to a plurality of working areas 5, 8.

As will be clear to the person skilled in the art, the invention is not limited to the elements 10 and/or supports 11 and/or light sources 10 in the form of a plurality of light sources L1-L3, etc., shown in the schematic drawings.

Figure 3A:
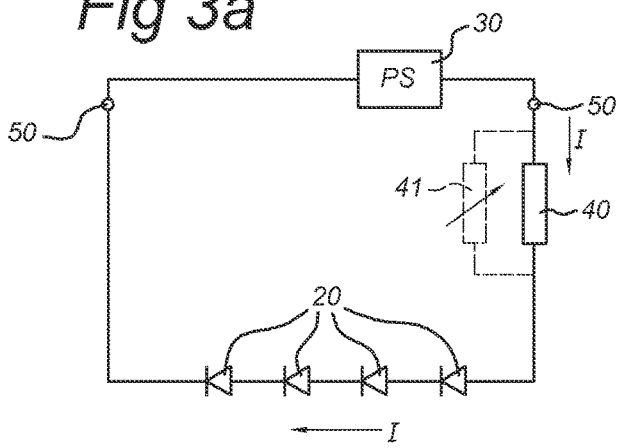
FIGS. 3*a*-13*b* schematically depict embodiments and variants thereof of aspects of a lighting unit and/or lighting system according to the invention.

FIG. 3*a* schematically shows an electrical schematic according to an embodiment of the invention. FIG. 3*a* shows an electrical power supply 30, an actuator 40 and a light source 20, as well as an optional controllable device 41. The actuator 40 and the light source 20 are connected in series to form a series arrangement. The series arrangement is electrically connected via power terminals 50 to the electrical power supply 30. The electrical power supply 30 provides, during use, an electrical power signal. In this embodiment, the electrical power supply 30 is a current source, arranged to provide a current to the series arrangement. The current may be controlled in dependence on a required orientation and light intensity of the light beam. The actuator 40 and the light source 20 are thus provided with the same current, which defines both the orientation of the light beam (as the current drives the actuator 40) and the light intensity of the light beam (as the current drives the light source 20). The current may e.g. be a DC-current with a current level that is amplitude modulated, wherein e.g. the light intensity is substantially proportional to the current level, and the orientation is e.g. substantially proportional to the power content of the current, which may be proportional to the square of the current level. The current may alternatively be e.g. a pulse-width modulated current with a fixed current level and a modulated pulse width, wherein e.g. the light intensity is substantially proportional to the pulse width, and the orientation is e.g. substantially proportional to the power content of the current, which may in this case be proportional to the square of the pulse width. The orientation thus has a pre-determined relationship with the light intensity, wherein the pre-determined relationship is determined from the relationships between orientation and current and between light intensity and current.

The pre-determined relationship may be a fixed relationship. The pre-determined relationship may alternatively e.g. be selected by a user or a controller from a plurality of different pre-determined relationships (which may also be referred to as presets). The lighting unit 1 may therefore optionally comprise a controllable device 41, to accommodate for this plurality of different pre-determined relationships, wherein the controllable device 41 is electrically arranged with the actuator 40 to adapt the current through the actuator 40, such as a controllable resistor 41 arranged in parallel with the actuator 40 as shown in FIG. 3*a*. Each pre-determined relationship of the plurality of different pre-determined relationships may correspond to a respective value of the controllable device 41, e.g. a respective resistor value; the current is then correspondingly distributed between a path through the actuator 40 and the controllable resistor 41, thereby defining the relationship between the current through the actuator 40 and the—total—current through the light source 20. In an alternative embodiment, the controllable device 41 is replaced by, or further comprises, a non-linear element, such as a Zener diode with a Zener voltage. The use of such a Zener diode may for example advantageously define the pre-determined relationship, with the effect that, for a large electrical power signal, corresponding to the voltage over the Zener diode being above the Zener voltage, the orientation of the light beam may remain substantially constant, while the light intensity can be increased by further increasing the electrical power signal: the pre-determined relationship may thus be a substantially proportional relationship below the electrical power signal level associated with the Zener voltage (which may be referred to as the threshold level), whereas the pre-determined relationship is substantially flat (i.e. the orientation is substantially constant for further increasing light intensities) above said threshold level.

In this and following examples, the light source 20 is drawn as a series connection of four light emitting diodes (LEDs), but the light source 20 may alternatively comprise different types of light sources and/or another plurality of light sources and/or another electrical arrangement of a plurality of light sources. The light source 20 may e.g. correspond to a first plurality of LEDs connected in series, forming a first series sub-arrangement, a second corresponding plurality of LEDs connected in series, forming a second series sub-arrangement, and the first and second series sub-arrangement being connected in parallel to form the light source 20.

Figure 3B:
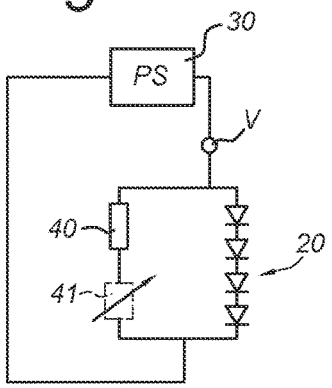

FIG. 3*b* schematically shows an electrical schematic according to an embodiment of the invention. FIG. 3*b* shows an electrical power supply 30, an actuator 40 and a light source 20, as well as optional controllable device 41. The actuator 40 and the light source 20 are connected in parallel to form a parallel arrangement. The parallel arrangement is electrically connected via power terminals 50 to the electrical power supply 30. The electrical power supply 30 provides, during use, an electrical power signal. In this embodiment, the electrical power supply 30 is a voltage source, arranged to provide a voltage to the parallel arrangement. The voltage may be controlled in dependence on a required orientation and light intensity of the light beam. The actuator 40 and the light source 20 are thus provided with the same voltage, which defines both the orientation of the light beam (as the voltage drives the actuator 40) and the light intensity of the light beam (as the voltage drives the light source 20).

The pre-determined relationship may be a fixed relationship. The pre-determined relationship may alternatively e.g. be selected by a user or a controller from a plurality of different pre-determined relationships (which may also be referred to as presets). The lighting unit 1 may therefore optionally comprise a controllable device 41, to accommodate for this plurality of different pre-determined relationships, wherein the controllable device is electrically arranged with the actuator 40 to adapt the current through the actuator 40, such as a controllable resistor 41 arranged in series with the actuator 40 as shown in FIG. 3*b*, wherein the series arrangement of actuator 40 and controllable resistor 41 is arranged in parallel with the light source. Each pre-determined relationship of the plurality of different pre-determined relationships may correspond to a respective value of the controllable device 41, e.g. a respective resistor value; the voltage is then correspondingly distributed over the actuator 40 and the controllable resistor 41, thereby defining the relationship between the voltage over the actuator 40 and the—total—voltage over the light source 20.

Figure 4:
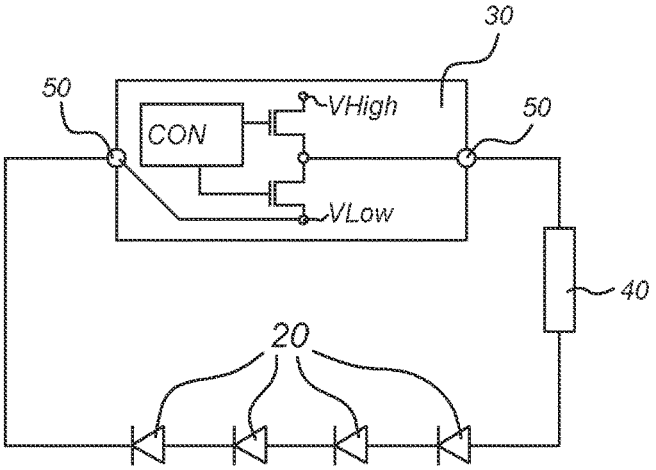

FIG. 4 schematically shows an electrical schematic according to an embodiment of the invention. FIG. 4 shows an electrical power supply 30, an actuator 40 and a light source 20. The actuator 40 and the light source 20 are connected in series to form a series arrangement. The series arrangement is electrically connected via power terminals 50 to the electrical power supply 30. The electrical power supply 30 provides, during use, an electrical power signal. In this embodiment, the electrical power supply 30 is a switched voltage supply, arranged to provide a voltage to the series arrangement. The voltage may be controlled in dependence on a required orientation and light intensity of the light beam. The actuator 40 and the light source 20 together form a load to the electrical power supply, which may be parameterized by its impedance. The series arrangement is thus provided with a current with a current level corresponding to the ratio of the voltage and the impedance. This current is thus supplied to the series arrangement of actuator 40 and light source 20. The actuator 40 and the light source 20 are thus provided with the same current, which defines both the orientation of the light beam (as the current drives the actuator 40) and the light intensity of the light beam (as the current drives the light source 20). The current may e.g. be a DC-current with a current level that is amplitude modulated, which is obtained by amplitude modulation of the voltage supplied by the power supply 30, and wherein e.g. the light intensity is substantially proportional to the current level, and the orientation is e.g. substantially proportional to the power content of the current, which may be proportional to the square of the current level. The current may alternatively be e.g. a pulse-width modulated current with a fixed current level and a modulated pulse width, wherein e.g. the light intensity is substantially proportional to the pulse width, and the orientation is e.g. substantially proportional to the power content of the current, which may in this case be proportional to the square of the pulse width. As shown in FIG. 4, the pulse-width modulated current may e.g. be established by the power supply 30 from switching between a low voltage level Vlow, preferably ground (or a non-zero reference voltage for defining an offset voltage and current), and a high voltage level Vhigh, using a pulse-width controller CON for operating a first switch 52 connected between an output node 51 and a first supply node conditioned at the high voltage level Vhigh and a second switch 53 connected between the output node 51 and a second supply node conditioned at the low voltage level Vlow.

Figure 5:
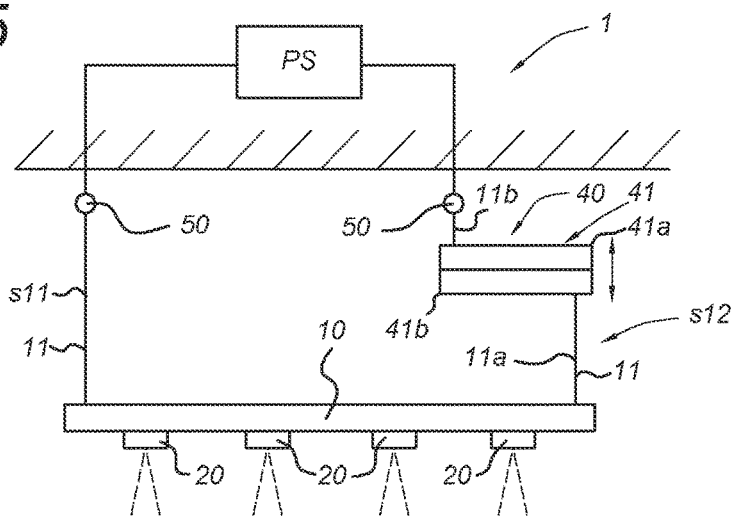

FIG. 5 shows an exemplary embodiment of a lighting unit 1 according to the invention. The lighting unit 1 comprises a single carrier 10 comprising a light source 20 comprising four light emitting diodes. The carrier 10 is suspended from the ceiling using two supports 11, individually referenced s11 and s12, and also referred to as suspensions 11. Thus, the carrier 10 is suspended from the ceiling by means of a first suspension s11 and a second suspension s12, wherein the second suspension s12 is provided with an actuator 40.

In this example, the actuator 40 comprises a bimetal spring, which is connected with its free-moving end 41*a* to the carrier 10 via a first suspension part 11*a* of the second suspension and connected via its other end 41*b* to the ceiling via suspension part 11*b* of the second suspension. Detailed embodiments of an actuator comprising a bimetal spring will be described below, with reference to FIGS. 11*a*-11*b* and FIGS. 12*a*-12*l*.

A power supply 30 is connected via power terminals 50 (shown schematically) to the actuator 40 and the light source 20, according to e.g. one of the embodiments described above in relation to FIG. 3*a*, FIG. 3*b* or FIG. 4. As an example, the power supply is the current source of FIG. 3*a*, arranged to provide a current to a series arrangement of the light source 20 and the actuator 40. As the current changes, so does the light intensity of the light beam generated by the light source 20. Also, as the current changes, the actuator 40 will lower or lift the carrier 10 with the second suspension s12. For example, when the actuator 40 comprises a bimetal spring, the current change will change the power dissipation in the bimetal spring 41, and thus its temperature, which makes the bimetal spring lift or lower its free-moving end. The functioning of the bimetal spring will be described in more detail below. The power terminals may simply be electrical plugs.

The lighting unit 1 shown in FIG. 5 may e.g. be used for illuminating an object on a wall from above. The object may e.g. be a painting in an exhibition space in a museum. When no visitors are present in the exhibition space, the lighting unit 1 may provide a low level of general lighting to the exhibition space, by illuminating substantially vertically downward from the ceiling. The painting is then exposed to light of a reduced intensity, as the light intensity is low and the light beam is not directed to the painting. However, when a visitor is in the exhibition space accommodating the painting, the light intensity increases and the orientation of the light beam is directed to the painting, such that the visitor can watch the painting in appropriate lighting conditions.

It will be appreciated that an array of lighting units 1 according to FIG. 5 may be used, e.g. positioned side-by-side, to provide a line of light that can be adjusted in light intensity and orientation.

Figure 6:
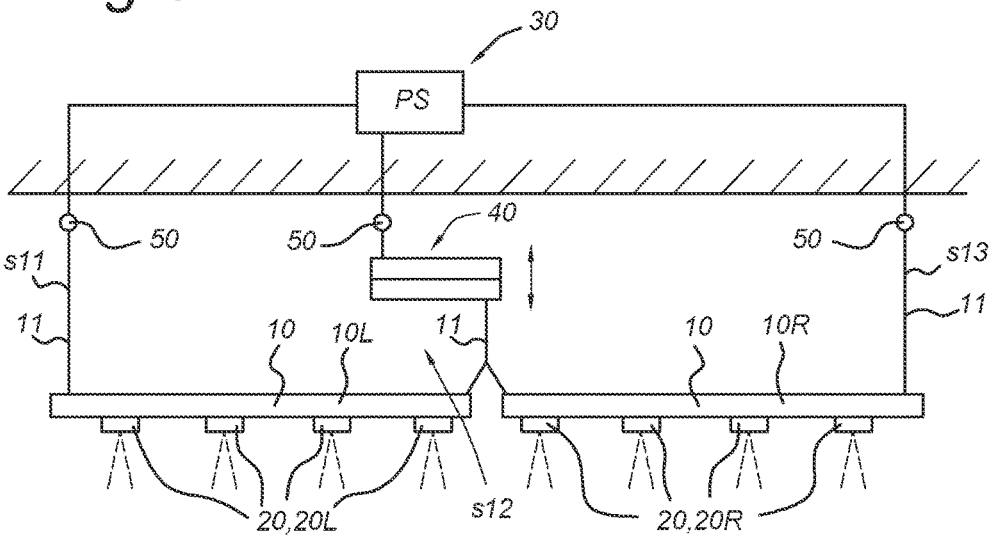

FIG. 6 shows another exemplary embodiment of a lighting unit 1 according to the invention. The lighting unit 1 comprises a plurality of carriers 10, in this case two are shown denoted as left carrier 10L and right carrier 10R, each comprising a respective light source 20 (denoted as respectively 20L and 20R) comprising four light emitting diodes, arranged to receive an electrical power signal (refer to FIGS. 7*a* and 7*b*). The two carriers 10 are suspended from the ceiling using three supports 11, individually denoted as s11, s12 and s13. In particular, the left carrier 10 is suspended from the ceiling with a first suspension s11 and a second suspension s12, wherein the second suspension s12 is provided with the actuator 40, arranged to receive an electrical power signal (refer to FIGS. 7*a* and 7*b*). The right carrier 10 is suspended from the ceiling by means of a third suspension s13 and the second suspension s12. The actuator 40, provided with the second suspension s12, is thus arranged to act on both carriers 10.

During use, a power supply 30 is connected via power terminals 50 (shown schematically) to the actuator 40, the light source 20L provided on the left carrier 10L and the light source 20R provided on the right carrier 10R. The power terminals are arranged to provide the electrical power signal to the actuator 40, the light source 20L and the light source 20R, e.g. according to the embodiment described below (FIGS. 7*a* and 7*b*), to generate light beams with an orientation according to a pre-determined relationship to the intensity of the light beam, as will be described in detail with reference to FIGS. 8*a* and 8*b*.

Figure 7A:
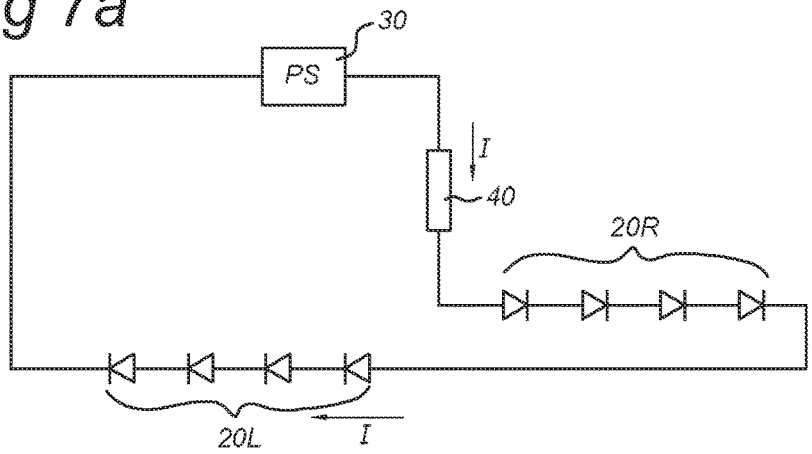

In a first embodiment, shown in FIG. 7*a*, actuator 40, light source 20L and light source 20R are all connected in series to form a series arrangement, and the series arrangement is connected, during use, to the power supply 30. The actuator 40, the light source 20L and the light source 20R thus all receive the same current. As a result, a pre-determined relationship between the light intensity of the light beams (determined by the current through the light sources 20L, 20R) and the orientation of the corresponding light beams (determined by the—same—current through the actuator 40) is obtained.

Figure 7B:
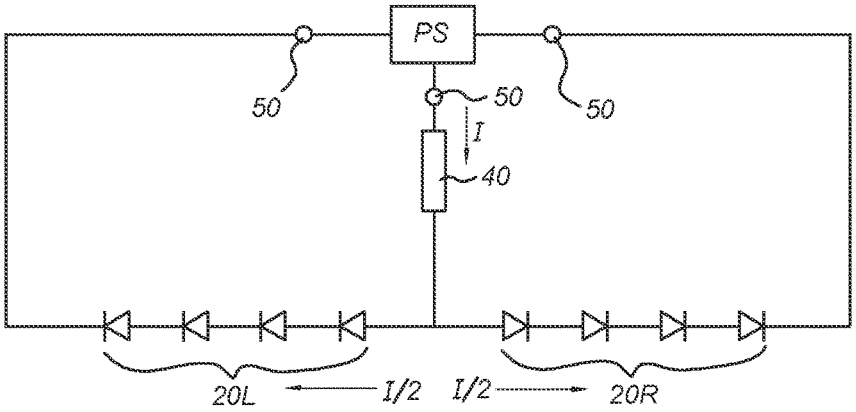

In a second embodiment, shown in FIG. 7*b*, the light source 20L and light source 20R are connected in parallel to a series arrangement of the actuator 40 and the power supply 30. In the example shown in FIG. 7*b*, the light source 20L and the light source 20R thus receive the same current, which is equal to half the current received by the actuator 40. As a result, a pre-determined relationship between the light intensity of the light beams (determined by the current through the light sources 20L, 20R) and the orientation of the corresponding light beams (determined by the—double—current through the actuator 40) is obtained.

Figure 8A:
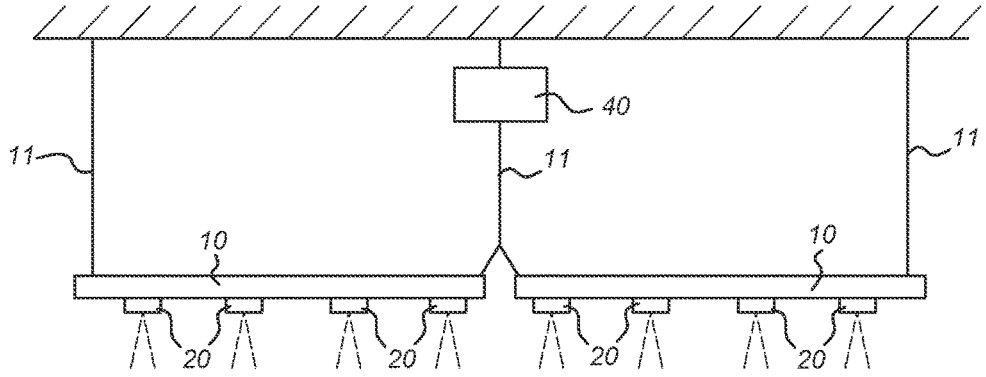
Figure 8B:
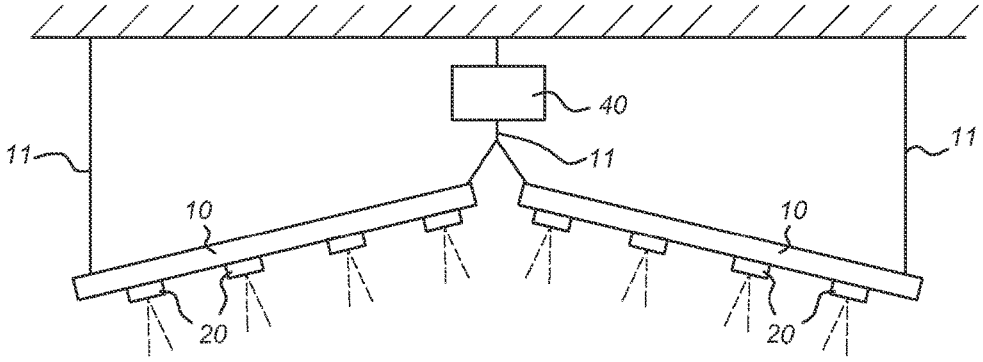

FIG. 8*a* and FIG. 8*b* illustrate the use of the lighting unit 1 according to any one of the embodiments of FIG. 6, FIG. 7*a* and FIG. 7*b*. FIG. 8*a* shows the carriers 10 with an orientation corresponding to for instance general lighting, i.e. with a flat illumination profile at a moderate brightness, wherein the actuator 40 acts on the carriers 10 so that the carriers 10 are substantially aligned in a plane. FIG. 8*b* shows the carriers 10 with an orientation corresponding to concentrated lighting, e.g. task lighting, i.e. with a concentrated illumination profile at a larger brightness, wherein the actuator 40 acts on the carriers 10 so that the carriers 10 are at an angle relative to each other.

With the embodiments of FIG. 6, FIG. 7*a* FIG. 7*b*, FIG. 8*a* and FIG. 8*b*, a pre-determined relationship between the light intensity of the light beams and the orientation, in particular the degree of concentration, of the light beams is obtained.

Figure 9A:
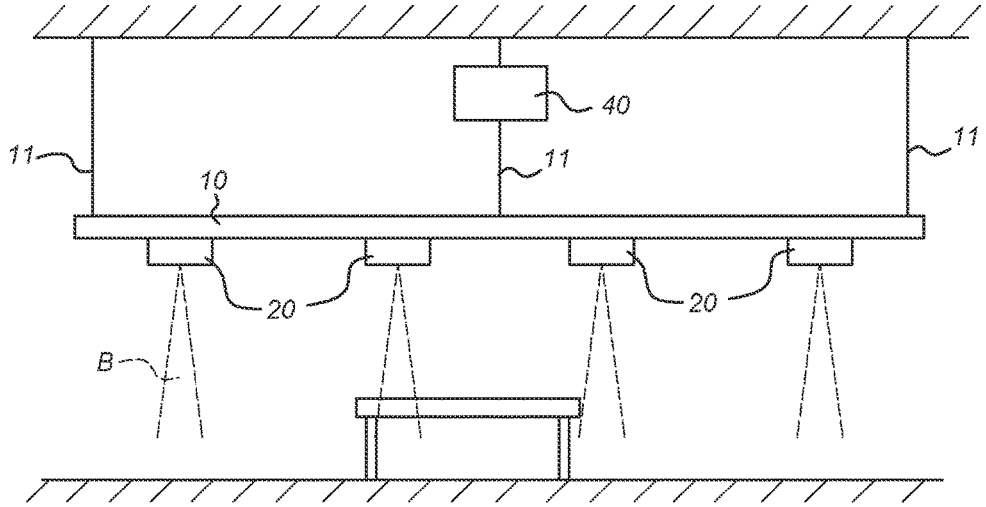
Figure 9B:
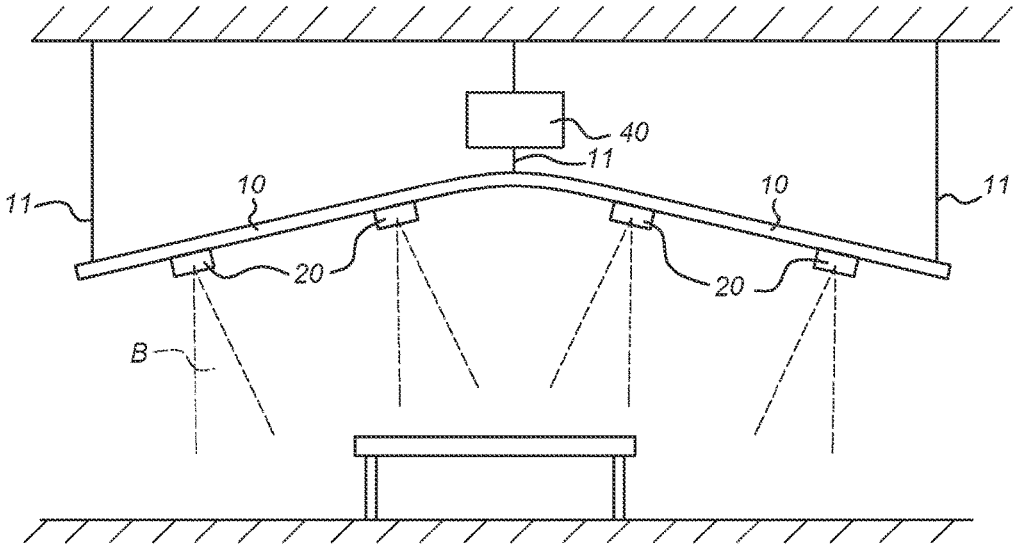

FIG. 9*a* and FIG. 9*b* illustrate an alternative embodiment, where a single carrier 10 is suspended from the ceiling using passive suspensions at its end, and one central suspension provided with an actuator 40. In this alternative embodiment, the single carrier 10 is a pliable surface, and the supports 11 are preferably rigid supports, which hold and tighten the pliable surface. FIG. 9*a* illustrates that such a pliable surface may be provided as a flat surface for providing uniform illumination, e.g. as general lighting, when e.g. the current level is moderate, and thus the light level is low and the orientation is de-focussed and spread. FIG. 9*b* shows that such a pliable surface may be shaped when the current is changed, and the light intensity and orientation change accordingly.

Figure 10A:
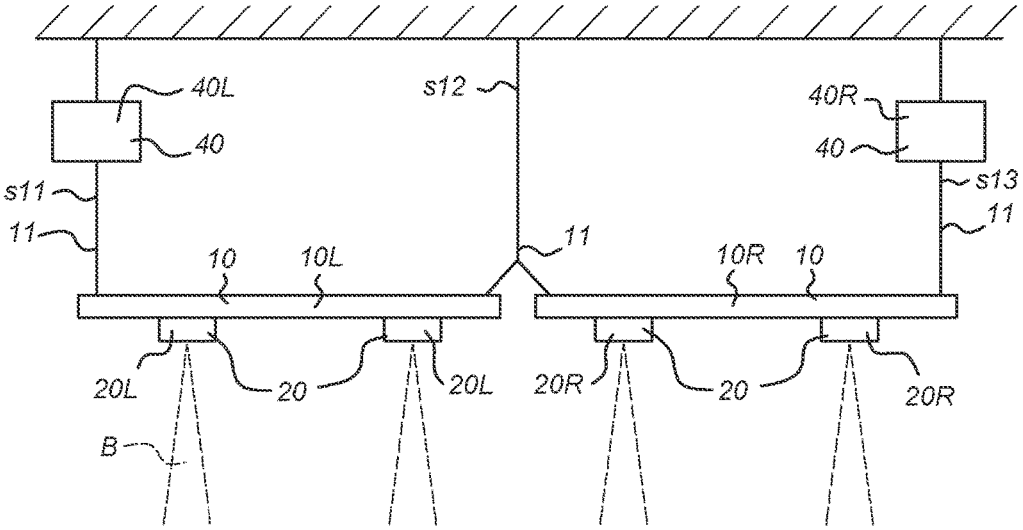
Figure 10B:
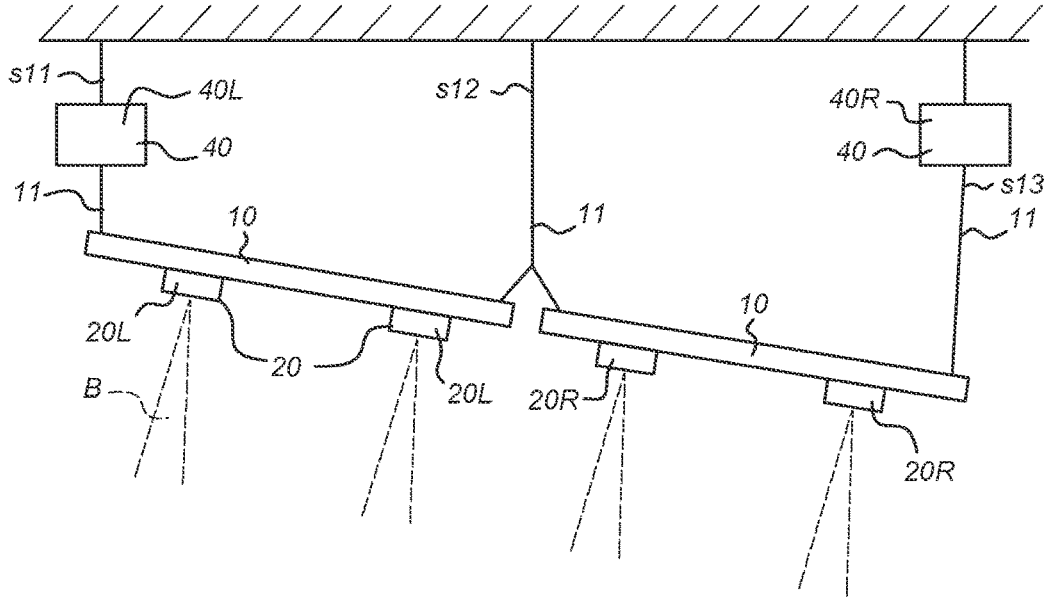

FIG. 10*a* and FIG. 10*b* show another exemplary embodiment of a lighting unit 1 according to the invention. The lighting unit 1 comprises a plurality of carriers 10, in this case two are shown denoted as left carrier 10L and right carrier 10R, each comprising a respective light source 20 (denoted respectively 20L and 20R) comprising four light emitting diodes. The two carriers 10 are suspended from the ceiling using three supports 11, individually referenced s11, s12 and s13. The two carriers 10 are arranged to be oriented using two actuators 40, individually referenced as 40L and 40R. In particular, the left carrier 10 is suspended from the ceiling by means of a first suspension s11 and a second suspension s12, wherein the first suspension s11 is provided with actuator 40L. The right carrier 10 is suspended from the ceiling by means of the second suspension s12 and a third suspension s13, wherein the third suspension s13 is provided with actuator 40R. The second suspension s12, is thus used to centrally suspend both carriers 10L and 10R, and each carrier 10L, 10R can be individually oriented with its respective actuator 40L, 40R. Actuator 40L and light source 20L are electrically connected, e.g. in series, to each other. Actuator 40R and light source 20R are electrically connected, e.g. in series, to each other, but electrically isolated from actuator 40L and light source 20R. During use, a first power signal is supplied to actuator 40L and light source 20L provided on the left carrier 10L, and a second power signal is supplied to actuator 40R and light source 20R provided on the right carrier 10R.

Figure 11A:
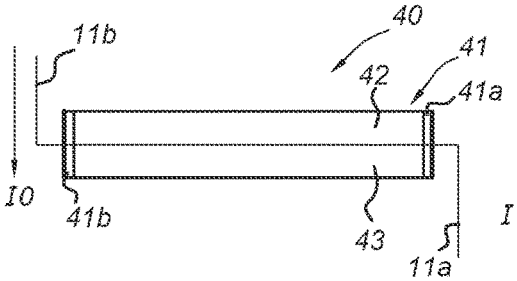
Figure 11B:
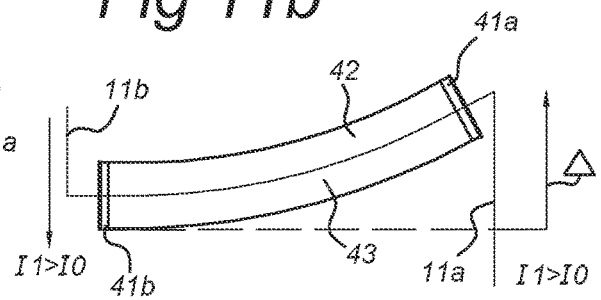

FIG. 11*a* and FIG. 11*b* show an exemplary embodiment of an actuator 40 for use in a lighting unit 1 according to the invention. In this embodiment, the actuator 40 comprises a bimetal spring, which is connected with its free-moving end 41*a* to the carrier 10 via a first suspension part 11*a* of the corresponding suspension and connected via its other end 41*b* to the ceiling via suspension part 11*b* of the suspension.

The actuator 40 is arranged to be connected to a power supply 30, e.g. as described in one of the embodiments described above. As an example, the power supply may be the current source of FIG. 3*a*, arranged to provide a current to a series arrangement of the light source 20 and the actuator 40. As the current changes, e.g. increases from a first current level I0 to a larger current level I1, the power dissipation in the bimetal spring 41 will change, and thus its temperature, which has a different effect on the length of the different layers of the bimetal spring, causing the bimetal spring to change its shape and lift or lower its free-moving end accordingly, as is indicated by Δ in FIG. 11*b*.

FIGS. 12*a*-12*l* illustrate possible embodiments of the bimetal spring 41. FIG. 12*a*-FIG. 12*l* illustrate embodiments in which the bimetal spring 41 comprises a stack of at least two layers of different, conductive materials: a first layer 42 and a second layer 43. The first layer 42 may e.g. be a first metal layer, e.g. a tungsten layer, and the second layer 43 may e.g. be a second metal layer, e.g. a copper layer, wherein the second layer has a larger thermal expansion coefficient than the first layer, such that the first and the second layer will have a different change in length when their temperature changes. As a result, the bimetal spring will change its shape, and move its free-moving end accordingly.

Figure 12A:
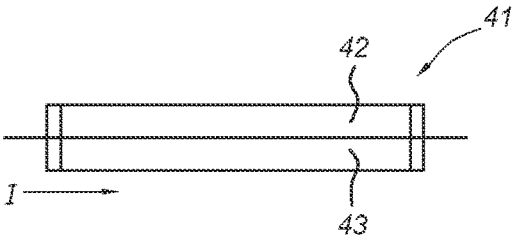
Figure 12B:
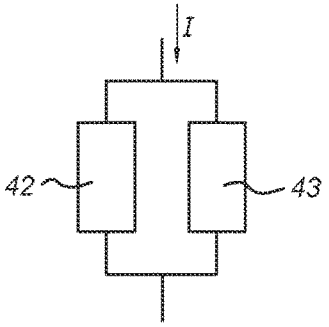

FIG. 12*a* illustrates a bimetal spring 41 according to a first embodiment. The bimetal spring 41 comprises a laminate of the first layer 42 and the second layer 43, laminated onto each other. The laminate 41 is electrically connected to the power supply signal, with the equivalent schematic e.g. corresponding to a parallel arrangement of a first resistor, corresponding to the first layer 42, and a second resistor, corresponding to the second layer 43, as shown in FIG. 12*b*. When a current I passes through these layers, power is dissipated due to the resistivity of the layers. It is believed that the power dissipation is in first order (apart from e.g. temperature effects on the resistance of the respective layers) proportional to the square of the current level (or its mean, when the current is pulsed): the bimetal spring 41 will thus acquire a temperature dependent on the current I.

Figure 12C:
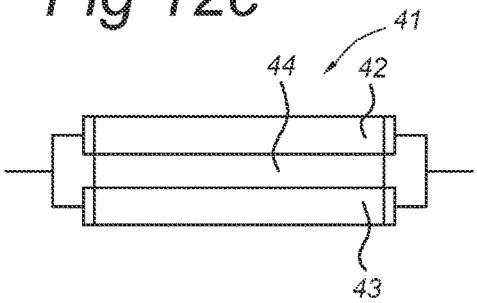
Figure 12D:
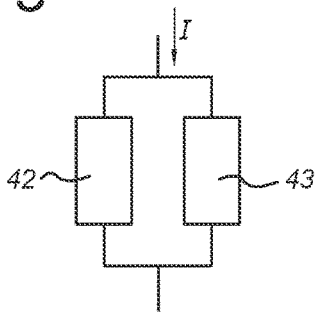

FIG. 12*c* illustrates a bimetal spring 41 according to a second embodiment. The bimetal spring 41 comprises a laminate of the first layer 42, an intermediate layer 44 and the second layer 43. The intermediate layer 44 is preferably an electrically insulating layer. The embodiment thus differs from that of FIG. 12*a*, in that the intermediate electrically insulating layer 44 is provided in between the first layer 42 and the second layer 43. The laminate 41 is again electrically connected to the power supply signal, e.g. a current I, with the equivalent schematic e.g. corresponding to a parallel arrangement of a first resistor, corresponding to the first layer 42, and a second resistor, corresponding to the second layer 43, as shown in FIG. 12*d*. In an alternative embodiment, the intermediate layer 44 is a deformable layer, designed to absorb stresses between the first layer 42 and the second layer 43 when expanding, and thus prevent the laminate from being damaged, e.g. due to delamination.

Figure 12E:
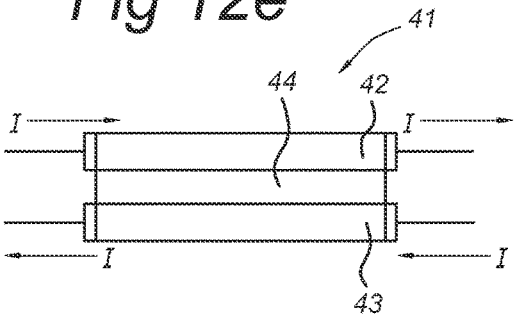
Figure 12F:
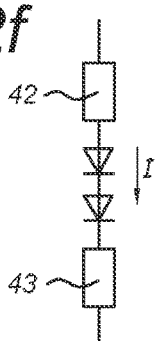

FIG. 12*e* illustrates a bimetal spring 41 according to a third embodiment. The bimetal spring 41 comprises a laminate of the first layer 42, an intermediate electrically insulating layer 44 and the second layer 43. The first layer 42 and the second layer 43 are arranged to electrically connect to the light source 20 in a series connection, as is indicated in FIG. 12*f*. During use, the current path extends through the first layer 42, the light source 20 and the second layer 43, as indicated by means of current I in FIG. 12*e* and FIG. 12*f*. The first layer 42 and the second layer 43 thus experience the same current I, and the current is not divided over the first layer 42 and the second layer 43 as in FIG. 12*a* and FIG. 12*b*; the current through each of the first and the second layer is thus larger as compared to the situation of FIG. 12*a* and FIG. 12*c*. This may advantageously result in a more effective heating of the bimetal spring.

Figure 12G:
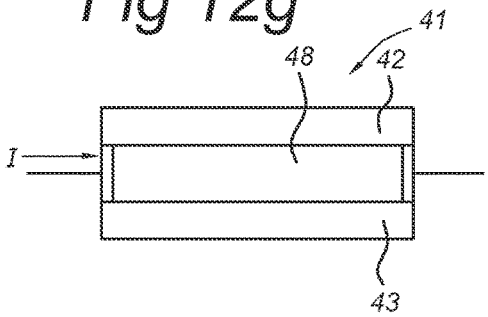
Figure 12H:
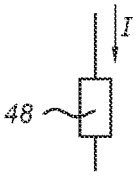

FIG. 12*g* illustrates a bimetal spring 41 according to a fourth embodiment. The bimetal spring 41 comprises a laminate of the first layer 42, a heating layer 48 and the second layer 43. In this embodiment, the heating layer 48 preferably has a lower resistance than the first and the second layer, such that the current I substantially completely flows through the heating layer 48 and only little, if any, current flows through the first and the second layer. The heating layer 48 is in thermal communication with the first layer 42 and the second layer 43, and serves to heat the first layer 42 and the second layer 43 when the heating layer 48 is provided with the electrical power signal. The laminate 41 may thus be electrically connected to the power supply signal for receiving a current I, and the equivalent schematic e.g. may correspond to a resistor corresponding to the heating layer 48, as shown in FIG. 12*h*. In an advantageous embodiment, the first layer 42 and the second layer 43 are non-conductive, or at least poorly conductive, and selected e.g. for their large difference in thermal expansion coefficient. In particular, it may be advantageous to select one of the first and the second layer so as to have a relatively large thermal expansion coefficient, resulting in a large displacement with low currents and low heat dissipation.

Figure 12I:
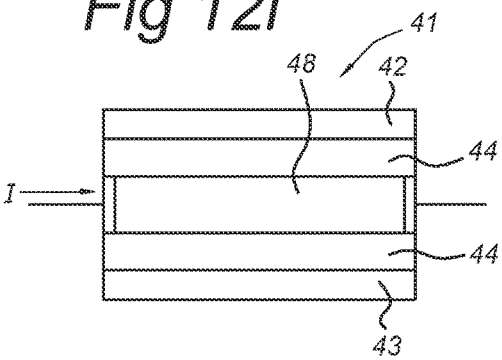
Figure 12J:
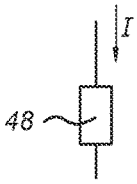

FIG. 12*i* illustrates a bimetal spring 41 according to a fifth embodiment. The bimetal spring 41 comprises a laminate of the first layer 42, a first intermediate electrically insulating layer 44, a heating layer 48, a second intermediate electrically insulating layer 44 and the second layer 43. The first and the second intermediate electrically insulating layers 44 serve to electrically isolate the heating layer 48 from the first layer 42 and the second layer 43, allowing the use of electrically conductive materials in the first and/or the second layer, thus largely separating the electrical behaviour (determined largely by the heating layer) from the mechanical behaviour (determined largely by the thermal expansion behaviour of the first layer 42 and the second layer 43). As in FIG. 12*g*, the heating layer 48 is in thermal communication with the first layer 42 and the second layer 43, and serves to heat the first layer 42 and the second layer 43 when the heating layer 48 is provided with the electrical power signal. Again, the laminate 41 may be electrically connected to the power supply signal for receiving a current I, with the equivalent schematic corresponding to a resistor corresponding to the heating layer 48, as shown in FIG. 12*i*.

Figure 12K:
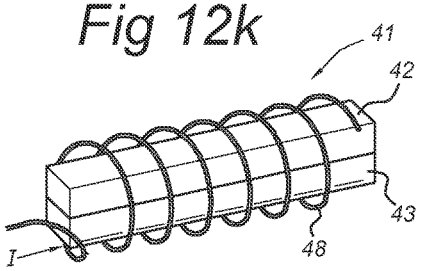
Figure 12L:
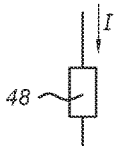

FIG. 12*k* illustrates a bimetal spring 41 according to a sixth embodiment. The bimetal spring 41 comprises a laminate of the first layer 42 and the second layer 43, with a wire-heater 48 wound around the laminate. An intermediate electrically insulating layer (not shown) may be provided in between the wire-heater and the laminate, to prevent electrical contact. The wire-heater 48 may e.g. be a constantan wire, advantageously allowing the thermal dependency of the resistance of the bimetal spring 41 and thus of the actuator 40 to be substantially removed. The wire-heater 48 is in thermal communication with the first layer 42 and the second layer 43, and serves to heat the first layer 42 and the second layer 43 when the wire-heater 48 is provided with the electrical power signal. Again, the laminate 41 may be electrically connected to the power supply signal for receiving a current I, with the equivalent schematic corresponding to a resistor corresponding to the wire heater 48, as shown in FIG. 12*l*.

Figure 13A:
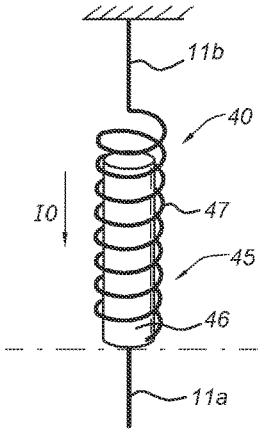
Figure 13B:
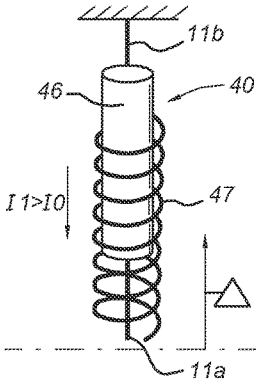

FIG. 13*a* and FIG. 13*b* show an alternative exemplary embodiment of an actuator 40 for use in a lighting unit 1 according to the invention. In this embodiment, the actuator 40 comprises an electromechanical solenoid 45 comprising a core 46 inside an electromagnetically inductive coil 47. The core 46 is connected to the carrier 10 via suspension 11*a*, and the coil 47 is fixed to the ceiling via suspension 11*b*. The core 46 is, during use, in electromagnetic communication with the coil 47. Thus, when the current through the coil 47 changes, the core 46 will move relative to the coil 47, and act on the carrier 10 for orienting the light beam generated by the light source 20 on the carrier 10. For example, when the current changes from a first current level I0 to a larger current level I1, the core 46 may move upward with a displacement Δ, as indicated in FIG. 13*b*. The solenoid 45 is, at least during use, connected to the power supply 30 and the light source 20, and arranged to receive the same power supply signal (e.g. current) as the light source 20. The orientation and light intensity of the light beam are thus coupled according to a pre-determined relationship, defined by the behaviour of core movement resulting from the power supply signal (e.g. current) and the corresponding behaviour of light intensity resulting from the power supply signal (e.g. current).

As an example, a commercially available solenoid may be used, comprising a plunger, a coil and a frame. Typically, such a solenoid may be available with different coil parameters. The common feature is the amp turns, i.e. the product of the current flowing through the coil and the number of turns. A smaller actuation current can be achieved by selecting a coil with a high number of turns, while in a high current system the same force will be generated by a high current supplied to a coil with fewer turns. Since the lighting installation will be used for extended periods of time, the solenoid is preferably selected according to its 100% duty cycle rating, while during short high brightness intensity periods (e.g. to signal a special situation for a limited time) higher currents are allowed, which will also result in higher forces.

To give a practical example: a solenoid having the dimensions 50 mm×38 mm×30 mm and a plunger diameter of 15 mm will be able to generate a force of up to 50 N and will have a stroke of up to 25 mm in steady state operation. Given the relatively low weight of e.g. LEDs and the possibility to use a lightweight supporting construction, this high force would allow placing the solenoid at a location within the carrier other than at the end to have a larger displacement.

In an alternative embodiment, the coil 47 is connected to the carrier 10 via a suspension, the core 46 is fixed to the ceiling, and changing the current through the coil 47 results in a movement of the coil 47, and thus a change of orientation of the connected carrier 10.

It will be appreciated that, without departing from the scope of the invention, other embodiments may also be envisaged by the skilled person, in which the electromechanical solenoid 45 has a different physical arrangement.

Figure 14:
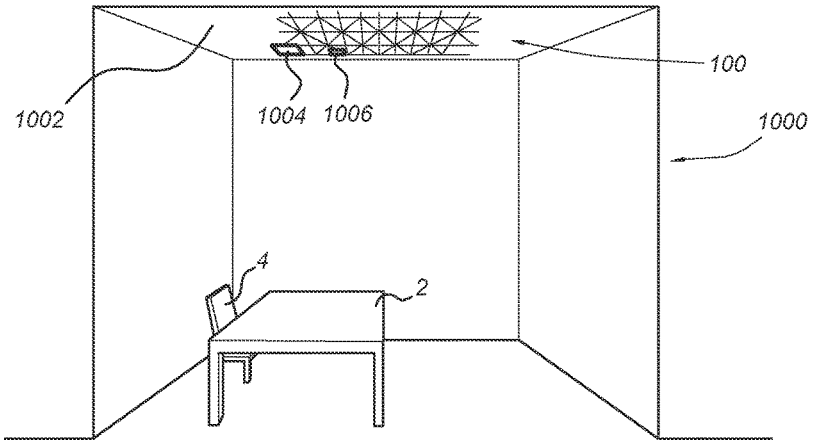
FIG. 14 schematically depicts an embodiment of a space according to the invention.

FIG. 14 shows a space 1000 comprising a lighting system 100 according to the invention. The lighting system 100 is, by way of example, attached to a ceiling 1002 of the space. A table 2 and chair 4 are positioned in the space. The positions of the table 2 and the chair 4 may be changed. Also, the number of tables and chairs may be changed, e.g. to accommodate visitors when the space is a living room or to accommodate additional workspaces when the space is an office space.

The lighting system 100 may further be connected to a controller 1004, which may be arranged external to the lighting system 100, e.g. on the ceiling 1002 itself, but which may also be integrated in the lighting system 100. The controller 1004 is especially arranged to control the lighting system 100, and more especially the intensities and orientations of the light beams of different lighting units 1 of the lighting system 100.

Further, the intensities and orientations of the plurality of light beams forming the illumination profile generated by the lighting system 100 may be dependent on a sensor signal of a sensor 1006 (such as an approach sensor, a fire sensor, a smoke sensor, a thermal sensor, etc.), wherein the sensor is arranged to sense an object on or in area that can be illuminated by the lighting system 100 or to sense a feature selected from the group consisting of smoke and heat, and wherein the controller 1004 is arranged to control intensity and orientation of each of the light beams for forming the illumination profile generated by the lighting system 100 in dependence on the sensor signal. Therefore, in yet another embodiment, the lighting system further comprises a sensor, such as an approach sensor or a smoke sensor or a thermal sensor, etc., which may be arranged external to the lighting system 100 but which may also be integrated in the lighting system 100. The term sensor may also refer to a plurality of sensors. Such a plurality of sensors may for instance be arranged to sense the same parameter (like touch of a user) at different locations, or to sense different parameters (like touch of a user and smoke, respectively).

In the drawings, less relevant features like electrical cables, etc. have not (all) been drawn, for the sake of clarity.

The term "substantially" herein, such as in "substantially flat" or "substantially consists", etc., will be understood by the person skilled in the art. In embodiments the adjective substantially may be removed. Where applicable, the term "substantially" may also include embodiments with "entirely", "completely", "all", etc. Where applicable, the term "substantially" may also relate to 90% or higher, such as 95% or higher, especially 99% or higher, including 100%. The term "comprise" includes also embodiments wherein the term "comprises" means "consists of".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in sequences other than described or illustrated herein.

The devices herein are amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The term "and/or" includes any and all combinations of one or more of the associated listed items. The article "a" or "an" preceding an element does not exclude the presence of a plurality of such elements. The article "the" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A lighting unit, comprising:

at least two light sources provided on a first and a second carrier, each of the first and second carrier supported on a first and a second end by a respective first support and a second support, the respective second support positioned at an opposite end of the respective carrier from the first support, wherein the first support supports both the first carrier and the second carrier;

an actuator electrically connected to an electrical power supply in series with the at least two light sources to receive a single modulated current signal;

each of the at least two light sources generates a light beam having an orientation and a light intensity dependent upon the single modulated current signal directed thereto;

the actuator is affixed to the first support and mechanically acts upon one of the first and second carrier to change the orientation of the at least two light sources upon a corresponding change in the single modulated current signal by modifying an angle of each of the first and second carrier relative to the first support, such that the orientation of each of the light beams generated by the at least two light sources has a predetermined relationship to the light intensity of the light beams, wherein the predetermined relationship between the orientation of each of the light beams and the light intensity of each of the light beams is such that both the orientation and the light intensity of each of the light beams are directly dependent on the single modulated circuit.

2. The lighting unit according to claim 1, further comprising a power terminal, wherein the power terminal is electrically connectable to the electrical power supply, and wherein the power terminal is arranged to provide, during operation, the single modulated current signal.

3. The lighting unit according to claim 1, wherein the light intensity is dependent on an average level of the single modulated current signal.

4. The lighting unit according to claim 1, wherein the orientation is dependent on an average power of the single modulated current signal.

5. The lighting unit according to claim 1, wherein each of the at least two light sources comprises a light-emitting diode.

6. The lighting unit according to claim 1, wherein the actuator comprises a bimetal actuator element arranged to orient, during operation, the light beams generated by the at least two light sources in dependence upon the single modulated current signal.

7. The lighting unit according to claim 1, wherein the actuator comprises an electromechanical solenoid arranged to orient, during operation, the light beams generated by the at least two light sources in an orientation in dependence upon the single modulated current signal.

8. An adjustable lighting unit with controllable orientation, comprising:

a first and a second carrier, each of the first and second carrier supporting a plurality of LEDs;

a central support commonly affixed to a first end of the first and second carrier;

a power supply providing power to an actuator, the actuator interposed between the power supply and the central support;

wherein the first and second carrier have an adjustable output angle relative to the central support, the actuator receiving a single modulated electrical power signal, the actuator responsive to a change in the single modulated electrical power signal to modify the adjustable output angle;

the actuator mechanically acting upon the first end of the first and second carrier through the first central support to change the adjustable output angle orienting light output from the first and second carrier and to adjust a light intensity of corresponding light beams generated by the plurality of LEDs according to a pre-determined relationship between the adjustable output angle orienting the output light and the light intensity, wherein the predetermined relationship between the adjustable output angle orienting the output light and the light intensity is such that both the adjustable output angle orienting the output light and the light intensity are directly dependent on the single modulated electrical power signal.

* * * * *